US006820586B2

(12) United States Patent
Watanabe

(10) Patent No.: US 6,820,586 B2
(45) Date of Patent: Nov. 23, 2004

(54) ENGINE

(75) Inventor: Sei Watanabe, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/391,190

(22) Filed: Mar. 19, 2003

(65) Prior Publication Data

US 2003/0230257 A1 Dec. 18, 2003

(30) Foreign Application Priority Data

Mar. 20, 2002 (JP) ..... 2002-079736
Feb. 27, 2003 (JP) ..... 2003-050641

(51) Int. Cl.[7] ..... F02B 75/32
(52) U.S. Cl. ..... 123/197.1; 123/197.4
(58) Field of Search ..... 123/197.1, 197.4

(56) References Cited

U.S. PATENT DOCUMENTS 2,259,176 A 10/1941 Pitney et al.
4,517,931 A 5/1985 Nelson
4,917,066 A 4/1990 Freudenstein et al.
4,957,069 A 9/1990 Mederer

FOREIGN PATENT DOCUMENTS

DE 93 13 192 U 12/1993
JP 9-228853 9/1997

*Primary Examiner*—Noah P. Kamen
(74) *Attorney, Agent, or Firm*—Arent Fox PLLC

(57) ABSTRACT

The present invention relates to an engine in which the stroke of a piston at an expansion stroke is larger than that at a compression stroke. In order to ensure that a top dead center at each of intake and exhaust strokes and a top dead center at the compression stroke are at the same level, the following dimensions are determined according to an equation representing a level of a piston pin, so that the top dead center at each of the intake and exhaust strokes and the top dead center at the compression stroke are congruous with each other: a length of a second arm; a length of a first arm; a length of a control rod; a length of a connecting rod; a length from an axis of a crankshaft to axes of rotary shafts in a direction of a y-axis; a length from the axis of the crankshaft to the axes of the rotary shafts in a direction of an x-axis; an amount of offsetting of a cylinder axis from the axis of the crankshaft in the direction of the y-axis; an angle formed by the first and second arms; a length between the axis of the crankshaft and the crankpin; a length of a straight line connecting the axes of the rotary shafts; and an axis of a movable eccentric shaft and an angle when a crank angle is "0".

5 Claims, 22 Drawing Sheets

ENGINE

BACKGROUND OF THE INVENTION

1. Field of the Invention

The present invention relates to an engine comprising a connecting rod connected at one end to a piston through a piston pin, a first arm turnably connected at one end to the other end of the connecting rod and at the other end to a crankshaft through a crankpin, a second arm integrally connected at one end to the other end of the first arm, a control rod turnably connected at one end to the other end of the second arm, and a movable eccentric shaft mounted between eccentric positions of rotary shafts to which a power reduced at a reduction ratio of 1/2 is transmitted from the crankshaft, the movable eccentric shaft being connected to the other end of the control rod, the stroke of the piston at an expansion stroke being larger than that at a compression stroke.

2. Description of the Related Art

Such engines are conventionally known, for example, from U.S. Pat. No. 4,517,931 and Japanese Patent Application Laid-open No. 9-228853. In each of these engines, the stroke of the piston at an expansion stroke is larger than that at a compression stroke, whereby a larger expansion work is carried out in the same amount of air-fuel mixture drawn, so that the cycle thermal efficiency is enhanced.

In the conventionally known engine, it is common that the position of a top dead center at each of the intake and exhaust strokes and the position of the top dead center at the compression stroke are different from each other. However, if the position of the top dead center at each of the intake and exhaust strokes is higher in level than the position of the top dead center at the compression stroke, there is a possibility that the interference of each of intake and exhaust valves and a top of the piston with each other occurs. If the position of the top dead center at each of the intake and exhaust strokes is lower in level than the position of the top dead center at the compression stroke to avoid the interference, the top dead center at the compression stroke is further lower and hence, an enhancement in a compression ratio in the engine is not desired and it is difficult to operate the engine at a higher thermal efficiency. On the other hand, if the top dead center at the compression stoke is higher in level than the top dead center at each of the intake and exhaust strokes, there is a possibility that the scavenge provided by the piston is insufficient due to the lower level of the piston at the top dead center at each of the intake and exhaust strokes, and thus, a large amount of burned gas remains within a cylinder, thereby bringing about a reduction in output in a full-load state and the instability of burning in a lower-load state.

SUMMARY OF THE INVENTION

Accordingly, it is an object of the present invention to provide an engine, wherein the stroke of the piston at the expansion stroke is larger than that at the compression stroke and in addition, the top dead center at each of the intake and exhaust stroke and the top dead center at the compression stroke are at the same level, whereby the above-described problems are solved.

To achieve the above object, according to a first feature of the present invention, there is provided an engine comprising a connecting rod connected at one end to a piston through a piston pin, a first arm turnably connected at one end to the other end of said connecting rod and at the other end to a crankshaft through a crankpin, a second arm integrally connected at one end to the other end of said first arm, a control rod turnably connected at one end to the other end of said second arm, and a movable eccentric shaft mounted between eccentric positions of rotary shafts to which a power reduced at a reduction ratio 1/2 is transmitted from said crankshaft, said movable eccentric shaft being connected to the other end of said control rod, the stroke of said piston at an expansion stroke being larger than that at a compression stroke, wherein when various dimensions are represented as described below in an x-y plane constituted by an x-axis extending through an axis of said crankshaft along a cylinder axis and a y-axis extending through the axis of said crankshaft in a direction perpendicular to the x-axis: a length of said connecting rod is represented by L4; a length of said first arm is represented by L2; a length of said second arm is represented by L1; a length of said control rod is represented by L3; a length from the axis of said crankshaft to axes of said rotary shafts in a direction of the y-axis is represented by L5; a length from the axis of said crankshaft to the axes of said rotary shafts in a direction of the x-axis is represented by L6; an angle formed by said connecting rod with respective to the cylinder axis is represented by $\phi\mathbf{4}$; an angle formed by said first and second arm is represented by a; an angle formed by said second arm with the y-axis within the x-y plane is represented by $\phi\mathbf{1}$; an angle formed by said control rod with the y-axis is represented by $\phi\mathbf{3}$; an angle formed by a straight line connecting the axis of said crankshaft and said crankpin with the x-axis is represented by $\theta$; an angle formed by a straight line connecting the axes of said rotary shafts and the axis of said movable eccentric shaft with the x-axis is represented by $\theta p$; a value of the angle $\theta p$ is represented by $\gamma$ when the angle $\theta$ is "0"; a length between the axis of said crankshaft and said crankpin is represented by R; a length of the straight line connecting the axes of said rotary shafts and the axis of said movable eccentric shaft is represented by Rp; a rotational angular speed of said crankshaft is represented by $\omega$; and a ratio of the rotational speed of said movable eccentric shaft to the rotational speed of said crankshaft is represented by $\eta$ and the rotational direction thereof is represented by $\eta=+0.5$ or $\eta=-0.5$, the following equation is established:

$$L\mathbf{4}\cdot\sin\phi\mathbf{4}\cdot d\phi\mathbf{4}/dt+L\mathbf{2}\cdot\cos(\alpha+\phi\mathbf{1})\cdot d\phi\mathbf{1}/dt-R\cdot\omega\cdot\sin\theta=0$$

Wherein $$\phi\mathbf{4}=\arcsin\{L\mathbf{2}\cdot\cos(\alpha+\phi\mathbf{1})+R\cdot\sin\theta-\delta\}/L\mathbf{4}$$

$$d\phi\mathbf{4}/dt=\omega\cdot[-L\mathbf{2}\cdot\sin(\alpha+\phi\mathbf{1})\cdot\{R\cdot\cos(\theta-\phi\mathbf{3})-\eta\cdot Rp\cdot\cos(\theta p-\phi\mathbf{3})\}/\{L\mathbf{1}\cdot\sin(\phi\mathbf{1}+\phi\mathbf{3})\}+R\cdot\cos\theta)]/(L\mathbf{4}\cdot\cos\phi\mathbf{4})$$

$$\phi\mathbf{1}=\arcsin[(L\mathbf{3}^2-L\mathbf{1}^2-C^2-D^2)/\{2\cdot L\mathbf{1}\cdot\sqrt{(C^2+D^2)}\}]-\arctan(C/D)$$

$$\phi\mathbf{3}=\arcsin\{(R\cdot\cos\theta-L\mathbf{6}-Rp\cdot\cos\theta p+L\mathbf{1}\cdot\sin\phi\mathbf{1})/L\mathbf{3}\}$$

$$C=L\mathbf{5}+Rp\cdot\sin\theta p-R\cdot\sin\theta$$

$$D=L\mathbf{6}+Rp\cdot\cos\theta p-R\cdot\cos\theta$$

$$\theta p=\eta\cdot\theta+\gamma$$

$$d\phi\mathbf{1}/dt=\omega\cdot\{R\cdot\cos(\theta-\phi\mathbf{3})-\eta Rp\cdot\cos(\theta p-\phi\mathbf{3})\}/\{L\mathbf{1}\cdot\sin(\phi\mathbf{1}+\phi\mathbf{3})\}$$

and crank angles $\theta$ at a top dead center at each of the intake and exhaust strokes and at the top dead center at the compression stroke are determined from said equation, and the length L1 of said second arm; the length L2 of said first arm; the length L3 of said control rod; the length L4 of said connecting rod; the length L5 from the axis of said crankshaft to the axes of said rotary shafts in the direction of the y-axis; the length L6 from the axis of said crankshaft to the axes of said rotary shafts in the direction of the x-axis; the amount δ of offsetting of the cylinder axis from the axis of said crankshaft in the direction of the y-axis; the angle α formed by said first and second arms; the length R between the axis of said crankshaft and said crankpin; the length Rp of the straight line connecting the axes of said rotary shafts and the axis of said movable eccentric shaft and the angle θp when the angle θ is "0", are determined so that the top dead center at each of the intake and exhaust strokes and the top dead center at the compression stroke are congruous with each other, according to the following equation:

$$X=L4\cdot\cos\phi 4+L2\cdot\sin(\alpha+\phi 1)+R\cdot\cos\theta$$

which represents a level X of the piston pin at both said crank angles θ.

The operation according to the configuration of the first feature will be described below with reference to FIG. 5 diagrammatically showing the arrangements of the piston pin, the connecting rod, the crankshaft, the crankpin, the first arm, the second arm, the control rod and the movable eccentric shaft. When the coordinates (Xpiv and Ypiv) of the movable eccentric shaft are determined, a moving speed (dX/dt) of the piston pin is determined by differentiating the position of the piston pin in the direction of the x-axis determined by $\{X=L4\cdot\cos\phi 4+L2\cdot\sin(\alpha+\phi 1)+R\cdot\cos\theta\}$, and an equation provided when dX/d=0 has four solutions in a range of $-2\pi<\theta<2\pi$. The four solutions are associated with the motion of a 4-cycle engine, whereby crank angles providing a top dead center at a compression stroke, a top dead center at each of intake and exhaust strokes, a bottom dead center after an expansion stroke and a bottom dead center after the intake stroke are determined and used to determine various positions of the piston pin in the directions of the x-axis and the y-axis. When the position of the piston pin at the top dead center in the direction of the x-axis at compression stroke is represented by Xctdc; the position of the piston pin in the direction of the x-axis at the top dead center at each of the intake and exhaust strokes is represented by Xotdc; the position of the piston pin ion the direction of the x-axis at the bottom dead center after an expansion stroke is represented by Xebdc; and the position of the piston pin in the direction of the x-axis at the bottom dead center after the intake stroke is represented by Xibdc, a stroke Scomp at the compression stroke and a stroke Sexp at the compression stroke are represented by (Scomp=Xctdc−Xibdc) and (Sexp=Xotdc−Xebdc), respectively, and the length L1 of the second arm, the length L2 of the first arm, the length L3 of the control rod, the length L4 of the connecting rod, the length L5 from the axis of the crankshaft to the axes of the rotary shafts in the direction of the y-axis; the length L6 from the axis of the crankshaft to the axes of the rotary shafts in the direction of the x-axis; the amount δ of offsetting of the cylinder axis from the axis of the crankshaft in the direction of the y-axis; the angle α formed by the first and second arms; the length R between the axis of the crankshaft and the crankpin; the length Rp of the straight line connecting the axes of the rotary shafts and the axis of the movable eccentric shaft and the angle θp when the angle θ is "0", are determined so that Scomp<Sexp is satisfied and Xctdc=Xotdc is satisfied. Thus, the stroke of the piston at the expansion stroke can be set larger than that at the compression stroke and in addition, the top dead center at each of the intake and exhaust strokes and the top dead center at the compression stroke can be set at the same level. As a result, it is possible to prevent the occurrence of the interference of each of an intake valve and an exhaust valve and a top of the piston with each other; to provide an enhancement in compression ratio in the engine to enable the operation at a higher thermal efficiency, and to achieve the sufficient scavenge by the piston and to prevent a reduction in output in a full-load state and the instability of burning in a lower-load state.

According to a second feature of the present invention, in addition to the first feature, a locus of movement of the piston pin is determined to be fallen into a range between the x-axis and one of tangent lines parallel to the x-axis and tangent to a locus described at the expansion stroke by a point of connection between the connecting rod and the first arm, which is closest to the x-axis. With such feature, it is possible to reduce the friction of the piston and suppress a piston slap sound. More specifically, when the piston is at the expansion stroke, a large load is applied to the piston, but if the change in attitude of the piston is increased due to the large load at that time, the friction is increased and the piston slap sound is magnified. However, the above-described determination of the locus of movement of the piston pin ensures that the connecting rod is always inclined to one side at the expansion stroke, notwithstanding that the piston receives the large load at the expansion stroke, whereby the change in attitude of the piston can be suppressed to reduce the friction of the piston and to suppress the generation of the piston slap sound.

According to a third feature of the present invention, in addition to the second feature, the range of the crank angle at the expansion stroke is set larger than that at the intake stroke, and the range of the crank angle at the exhaust stroke is set larger than that at the compression stroke. With such configuration, it is possible to avoid the degradation of inertia vibration due to an increase in acceleration of the piston. More specifically, during lowering of the piston, the stroke at the expansion stroke is larger than that at the intake stroke, and during lifting of the piston, the stroke at the exhaust stroke is larger than that at the compression stroke. In the setting in which the top and bottom dead centers are alternated with each other at the crank angle of 180 degrees, the speed of the piston at each of the expansion and exhaust strokes at which the stroke is larger is higher than that at each of the intake and compression strokes at which the stroke is smaller, and the acceleration of the piston is increased due to such a large difference between the speeds, thereby bringing about the degradation of inertia vibration. However, by setting the range of the crank angle at each of the expansion and exhaust strokes at which the stroke is larger at a value larger than the range of the crank angle at each of the intake and compression strokes at which the stroke is smaller, as described above, the speed of the piston at each of the stokes can be further uniform to suppress the variation in acceleration of the piston at the bottom dead center after the intake and expansion strokes and the variation in acceleration of the piston at the top dead center after the intake and expansion strokes to avoid the degradation of inertia vibration.

According to a fourth feature of the present invention, in addition to the third feature, the ranges of the crank angles at the expansion and exhaust strokes are set at values exceeding 180 degrees, respectively. With such configuration, the speed of the piston at each of the intake, compression, expansion and exhaust strokes can be further uniform to more effectively suppress the variation in acceleration of the piston at the bottom dead center after the intake and expansion strokes and the variation in acceleration of the piston at the top dead center after the intake and expansion strokes, thereby more effectively avoiding the degradation of inertia vibration.

According to a fifth feature of the present invention, in addition to any of the first to fourth features, the movable eccentric shaft is mounted on the rotary shafts having the axes disposed at locations spaced within the x-y plane apart from the axis of the crankshaft by the lengths L5 and L6 in the directions of the y-axis and the x-axis, respectively, so that it is displaced from the axes of the rotary shafts by a distance corresponding to a radius Rp, and wherein when the length R between the axis of the crankshaft and the crankpin is set at 1.0, the length L1 of the second arm is set in a range of 1.7 to 4.5; the length L2 of the first arm is set in a range of 0.6 to 5.2; the length L3 of the control rod is set in a range of 4.3 to 6.9; the length L5 between the axis of the crankshaft and the rotary shafts in the direction of the y-axis is set in a ranger of 2.3 to 4.0; the length L6 between the axis of the crankshaft and the rotary shafts in the direction of the x-axis is set in a range of 0.00 to 3.35; and the radius Rp is set in a range of 0.25 to 1.80, as well as the angle a formed by the first and second arms is set in a range of 105 to 180 degrees. With such configuration, it is possible to provide the configuration of the fourth feature, thereby more effectively avoiding the degradation of inertia vibration.

The above and other objects, features and advantages of the invention will become apparent from the following description of the preferred embodiments taken in conjunction with the accompanying drawings.

BRIEF DESCRIPTION OF THE DRAWINGS

FIG. 1 is a partially cutaway front view of an engine;

FIG. 2 is a vertical sectional view of the engine, which corresponds to a sectional view taken along a line 2—2 in FIG. 3;

FIG. 3 is a sectional view taken along a line 3—3 in FIG. 2;

FIG. 4 is a sectional view taken along a line 4—4 in FIG. 3;

FIG. 5 is an illustration diagrammatically showing the disposition of a link mechanism;

FIG. 6 is a diagram showing operative states of the link mechanism sequentially;

FIG. 7 is a diagram showing a variation in position of a piston pin corresponding to a crank angle;

DESCRIPTION OF THE PREFERRED EMBODIMENTS

Figure 1:
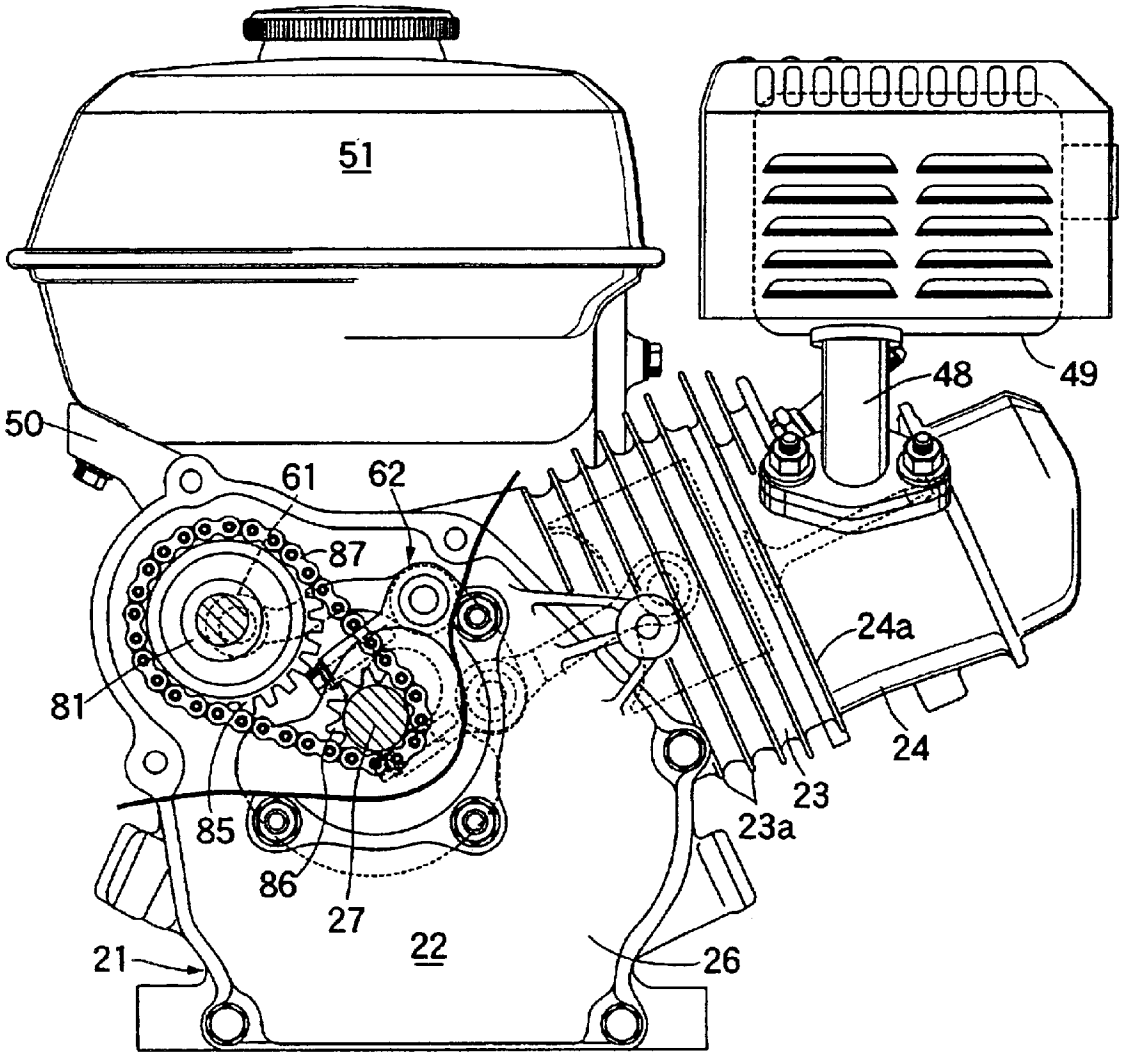
FIGS. 1 to 7 show a first embodiment of the present invention.
Figure 2:
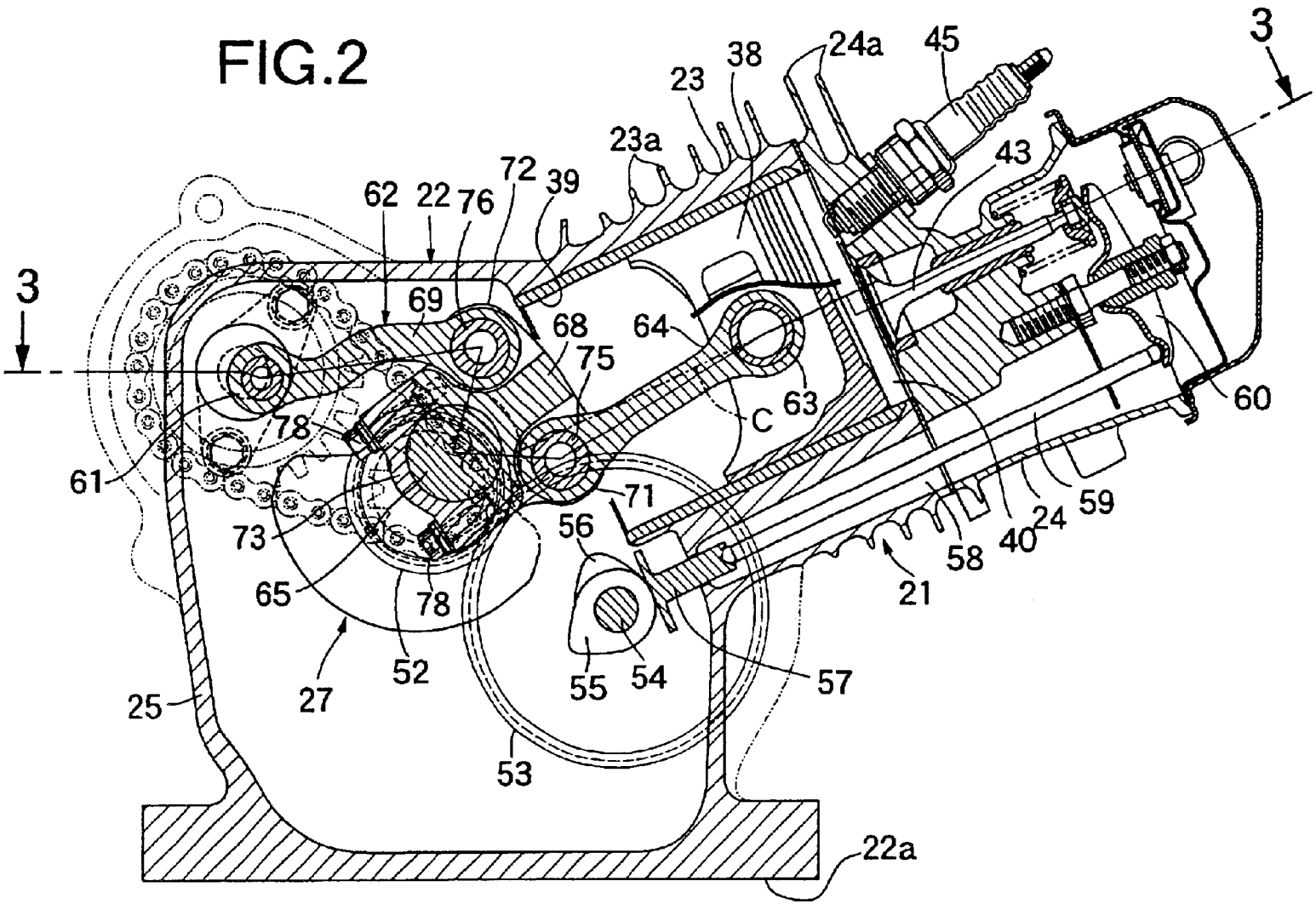
Figure 3:
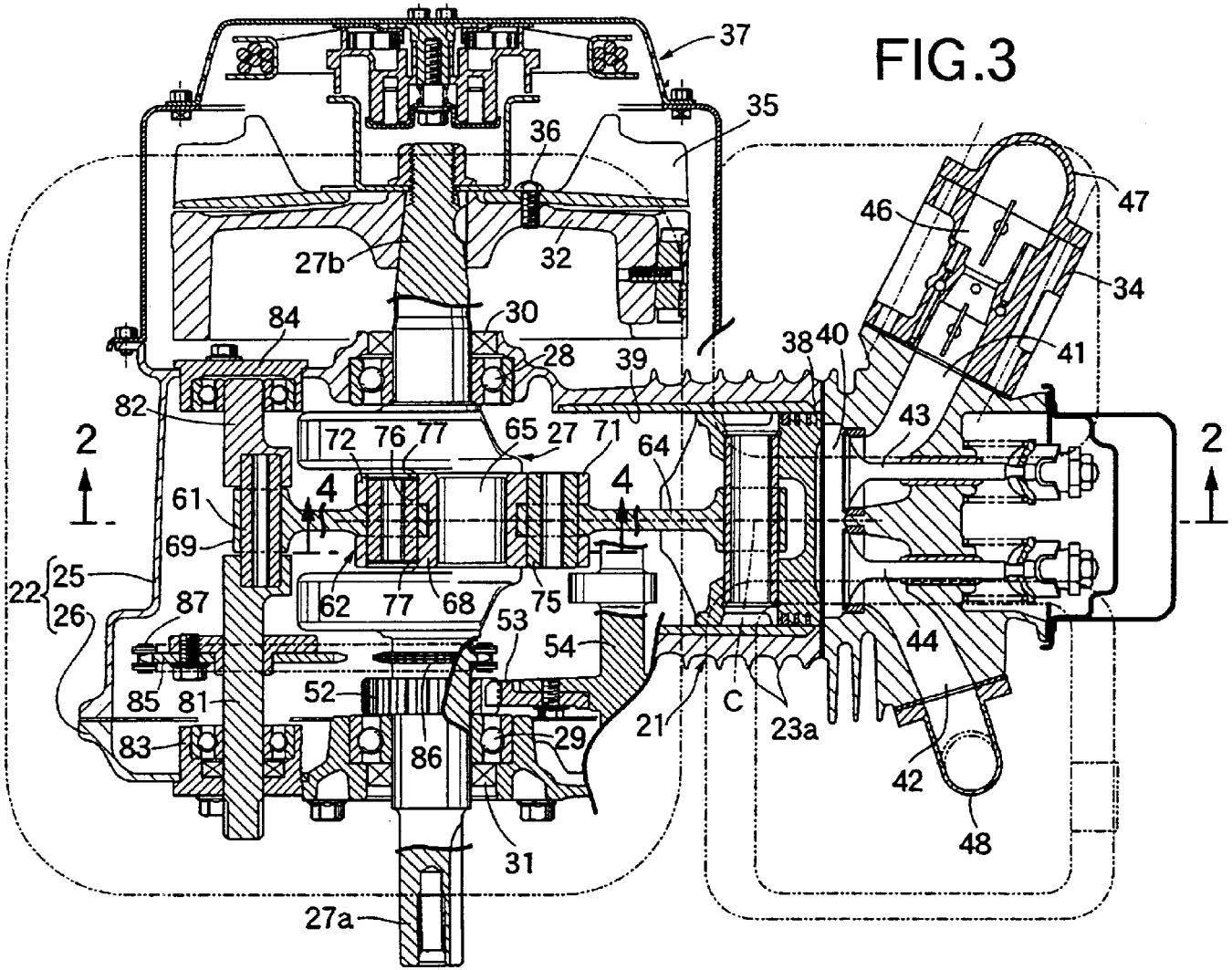

A first embodiment of the present invention will now be described with FIGS. 1 to 7. Referring first to FIGS. 1 to 3, an engine according to the first embodiment is an air-cooled single-cylinder engine used, for example, in a working machine or the like, and includes an engine body 21 which is comprised of a crankcase 22, a cylinder block 23 protruding in a slightly upward inclined state from one side of the crankcase 22, and a cylinder head 24 coupled to a head portion of the cylinder block 23. Large numbers of air-cooling fins 23*a* and 24*a* are provided on outer surfaces of the cylinder block 23 and the cylinder head 24. A mounting face 22*a* on a lower surface of the crankcase 22 is mounted on an engine bed of each of various working machines The crankcase 22 comprises a case body 25 formed integrally with the cylinder block 23 by a casting process, and a side cover 26 coupled to an open end of the case body 25, and a crankshaft 27 are rotatably carried at its opposite ends on the case body 25 and the side cover 26 with ball bearings 28 and 29 and oil seals 30 and 31 interposed therebetween. One end of the crankshaft 27 protrudes as an output shaft portion 27*a* from the side cover 26, and the other end of the crankshaft 27 protrudes as an auxiliary-mounting shaft portion 27*b* from the case body 25. Moreover, a flywheel 32 is fixed to the auxiliary-mounting shaft portion 27*b*; a cooling fan 35 for supplying cooling air to various portions of the engine body 21 and a carburetor 34 is secured to an outer surface of the flywheel 32 by a screw member 36, and a recoil-type engine stator 37 is disposed outside the cooling fan 36.

A cylinder bore 39 is defined in the cylinder block 23, and a piston 38 is slidably received in the cylinder bore 39. A combustion chamber 40 is defined between the cylinder block 23 and the cylinder head 24, so that a top of the piston is exposed to the combustion chamber 40.

An intake port 41 and an exhaust port 42 are defined in the cylinder head 24, and lead to the combustion chamber 40, and an intake valve 43 for connecting and disconnecting the intake port 41 and the combustion chamber 40 to and from each other and an exhaust valve 44 for connecting and disconnecting the exhaust port 42 and the combustion chamber 40 to and from each other, are openably and closably disposed in the cylinder head 24. A spark plug 45 is threadedly fitted into the cylinder head 24 with its electrodes facing to the combustion chamber 40.

The carburetor 34 is connected to an upper portion of the cylinder head 24, and a downstream end of an intake passage 46 included in the carburetor 34 communicates with the intake port 41. An intake pipe 47 leading to an upstream end of the intake passage 46 is connected to the carburetor 34 and also connected to an air cleaner (not shown). An exhaust pipe 48 leading to the exhaust port 42 is connected to the upper portion of the cylinder head 24 and also connected to an exhaust muffler 49. Further, a fuel tank 51 is disposed above the crankcase 22 in such a manner that it is supported on a bracket 50 protruding from the crankcase 22.

A driving gear 52 is integrally formed on the crankshaft 27 at a location closer to the side cover 26 of the crankcase 22, and a driven gear 53 meshed with the driving gear 52 is secured to a camshaft 54 rotatably carried in the crankcase 22 and having an axis parallel to the crankshaft 27. Thus, a rotating power from the crankshaft 27 is transmitted to the camshaft 4 at a reduction ratio of 1/2 by the driving gear 52 and the driven gear 53 meshed with each other.

The camshaft 54 is provided with an intake cam 55 and an exhaust cam 56 corresponding to the intake valve 43 and the exhaust valve 44, respectively, and a follower piece 57 operably carried on the cylinder block 23 is in sliding contact with the intake cam 55. On the other hand, an operating chamber 58 is defined in the cylinder block 23 and the cylinder head 24, so that an upper portion of the follower piece 57 protrudes from a lower portion of the operating chamber 58; and a pushrod 59 is disposed in the operating chamber 58 with its lower end abutting against the follower piece 57. On the other hand, a rocker arm 60 is swingably carried on the cylinder head 24 with its one end abutting against an upper end of the exhaust valve 44 biased in a closing direction by a spring, and an upper end of the pushrod 59 abuts against the other end of the rocker arm 60. Thus, the pushrod 59 is operated axially in response to the rotation of the intake cam 55, and the intake valve 43 is opened and closed by the swinging of the rocker arm 60 caused in response to the operation of the pushrod 59.

A mechanism similar to that between the intake cam 55 and the intake valve 43 is also interposed between the exhaust cam 56 and the exhaust valve 44, so that the exhaust valve 44 is opened and closed in response to the rotation of the exhaust cam 56.

Figure 4:
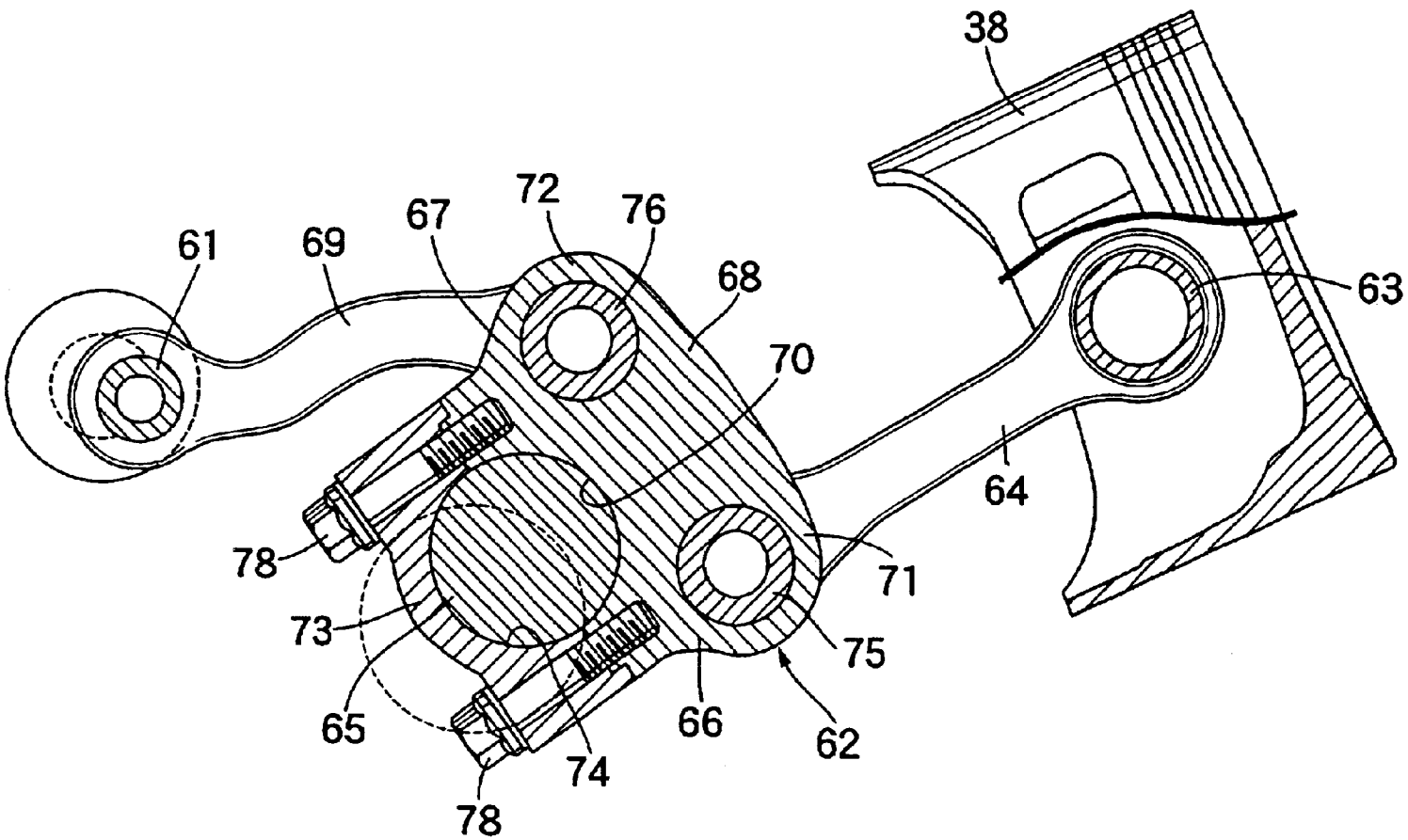
Figure 5:
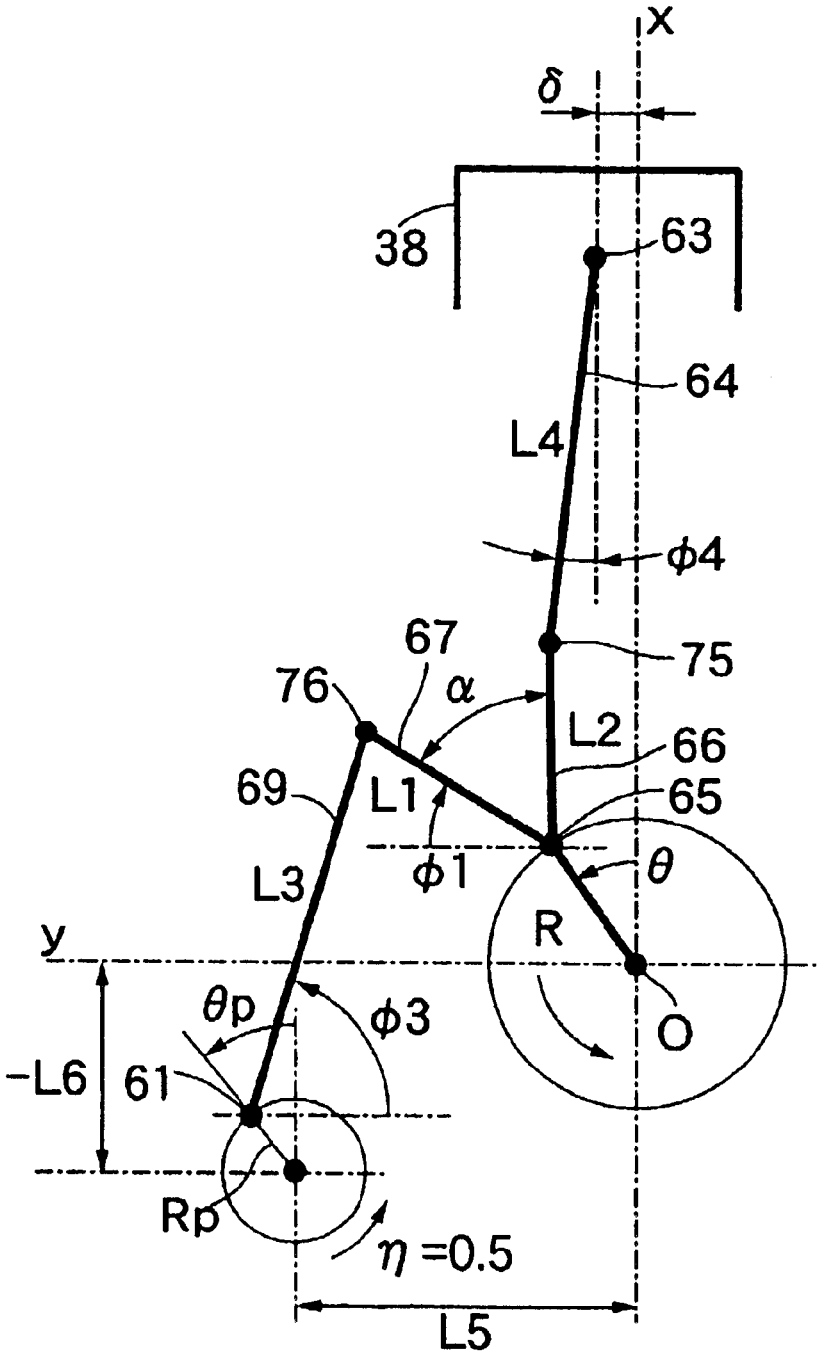

Referring also to FIG. 4, the piston 38, the crankshaft 27 and a movable eccentric shaft 61 carried in the crankcase 22 of the engine body 21 for displacement in a plane extending through a cylinder axis C and perpendicular to an axis of the crankshaft 27, are connected to one another through a link mechanism 62.

The link mechanism 62 comprises a connecting rod 64 connected at one end to the piston 38 through a piston pin 63, a first arm 66 turnably connected at one end to the other end of the connecting rod 64 and at the other end to a crankpin 65 of the crankshaft 27, a second arm 67 integrally connected at one end to the other end of the first arm 66, and a control rod 69 turnably connected at one end to the other end of the second arm 67 and at other end to the movable eccentric shaft 61. The first and second arms 66 and 67 are integrally formed as a subsidiary rod 68.

The subsidiary rod 68 includes a semi-circular first bearing portion 70 provided at its intermediate portion to come into sliding contact with half of a periphery of the crankpin 65, and a pair of bifurcated portions 71 and 72 provided at its opposite ends, so that the other end of the connecting rod 64 and one end of the control rod 69 are sandwiched therebetween. A semicircular second bearing portion 74 included in the crank cap 73 is in sliding contact with the remaining half of the periphery of the crankpin 65 of the crankshaft 27, and the crank cap 73 is fastened to the subsidiary rod 68.

The connecting rod 64 is turnably connected at the other end thereof to one end of the subsidiary rod 68, i.e., to one end of the first arm 66 through a connecting rod pin 75, which is press-fitted into the other end of the connecting rod 64 inserted into the bifurcated portion 71 at one end of the subsidiary rod 68 and which is turnably fitted at its opposite ends into the bifurcated portion 71 at the one end of the subsidiary rod 68.

The control rod 69 is turnably connected at one end to the other end of the subsidiary rod 68, i.e., to the other end of the second arm 67 through a cylindrical subsidiary rod pin 76, which is passed relatively turnably through one end of the control rod 69 inserted into the bifurcated portion 72 at the other end of the subsidiary rod 68, and which is clearance-fitted at its opposite end into the bifurcated portion 72 at the other end of the subsidiary rod 68. Moreover, a pair of clips 77, 77 are mounted to the bifurcated portion 72 at the other end of the subsidiary rod 68 to abut against the opposite ends of the subsidiary rod pin 76 for inhibiting the removal of the subsidiary rod pin 76 from the bifurcated portion 72.

The crank cap 73 is fastened to the bifurcated portions 71 and 72 by disposed pair by pair at opposite sides of the crankshaft 27, and the connecting rod pin 75 and the subsidiary rod pin 76 are disposed on extensions of axes of the bolts 78, 78.

The cylindrical movable eccentric shaft 61 is mounted between eccentric positions of a pair of rotary shafts 81 and 82 coaxially disposed and having axes parallel to the crankshaft 27. Moreover, the rotary shaft 81 is rotatably carried on a support portion 83 mounted to the side cover 26 of the crankcase 22, and the rotary shaft 82 is rotatably carried on a support portion 84 mounted to the case body 25 of the crankcase 22.

A follower sprocket 85 is fixed to the rotary shaft 81, and driving sprocket 86 is fixed to the crankshaft 27 at a location corresponding to the follower sprocket 85. An endless chain 87 is reeved around the driving sprocket 86 and the follower sprocket 85. Thus, a rotational power reduced at a reduction ratio of 1/2 is transmitted from the crankshaft 27 to the rotary shafts 81 and 82, and the movable eccentric shaft 61 mounted between the rotary shafts 81 and 82 is rotated in one rotation about axes of the rotary shafts every time the crankshaft 27 is rotated in two rotations.

By rotating the movable eccentric shaft 61 in the above manner, it is ensured that the stroke of the piston 38 at an expansion stroke is larger than that at a compression stroke. The dimensional relationship in the link mechanism for this purpose will be described with reference to FIG. 5.

Here, when various dimensions are represented as described below in an x-y plane constituted by an x-axis extending through an axis of the crankshaft 27 along a cylinder axis C and a y-axis extending through the axis of the crankshaft 27 in a direction perpendicular to the x-axis: i.e., a length of the connecting rod 64 is represented by L4; a length of the first arm 66 is represented by L2; a length of the second arm 67 is represented by L1; a length of the control rod 69 is represented by L3; a length of from the axis of the crankshaft 27 to the axes of the rotary shafts 81 and 82 in a direction of the y-axis is represented by L5; a length from the axis of the crankshaft 27 to the axes of the rotary shafts 81 and 82 in a direction of the x-axis is represented by L6; an angle formed by the connecting rod 64 with respective to the cylinder axis C is represented by $\phi$4; an angle formed by the first and second arms 66 and 67 with each other is represented by $\alpha$; an angle formed by the second arm 67 with the y-axis is represented by $\phi$1; an angle formed by the control rod 69 with the y-axis is represented by $\phi$3; an angle formed by a straight line connecting the axis of the crankshaft 27 and the crankpin 65 with the x-axis is represented by $\theta$; an angle formed by a straight line connecting the axes of the rotary shafts 81 and 82 and the axis of the movable eccentric shaft 61 with the x-axis is represented by $\theta p$; a value of the angle $\theta p$ when the angle $\theta$ is "0" is represented by $\gamma$; a length between the crankshaft 27 and the crankpin 65 is represented by R; a length of the straight line connecting the axes of the rotary shafts 81 and 82 and the axis of the movable eccentric shaft 61 is represented by Rp; a rotational angular speed of the crankshaft 27 is represented by $\omega$; and a ratio of the rotational speed of the movable eccentric shaft 61 to the rotational speed of the crankshaft 27 is represented by $\eta$ and the rotational direction thereof is by $\eta=+0.5$, a level X of the piston pin 63 is determined according to $$X=L4\cdot\cos\phi4+L2\cdot\sin(\alpha+\phi1)+R\cdot\cos\theta \quad (1)$$

wherein $\phi4=\arcsin\{L2\cdot\cos(\alpha+\phi1)+R\cdot\sin\theta-\delta\}/L4$ $\phi1=\arcsin[(L3^2-L1^2-C^2-D^2)/\{2\cdot L1\cdot\sqrt{(C^2+D^2)}\}]-\arctan(C/D)$ $C=L5+Rp\cdot\sin\theta p-R\cdot\sin\theta$ $D=L6+Rp\cdot\cos\theta p-R\cdot\cos\theta$ $\theta p=\eta\cdot\theta+\gamma$ Here, a speed of the piston pin 63 in a direction of the x-axis is determined according to the following equation by differentiating the above-described equation (1):

$$dX/dt=-L4\cdot\sin\phi4\cdot d\phi4/dt+L2\cdot\cos(\alpha+\phi1)\cdot d\phi1/dt-R\cdot\omega\cdot\sin\theta \quad (2)$$

Wherein $d\phi4/dt=\omega\cdot[-L2\cdot\sin(\alpha+\phi1)\cdot\{R\cdot\cos(\theta-\phi3)-\eta\cdot Rp\cdot\cos(\theta p-\phi3)\}/\{L1\cdot\sin(\phi1+\phi3)\}+R\cdot\cos\theta)\}]/(L4\cdot\cos\phi4)$ $\phi3=\arcsin\{(R\cdot\cos\theta-L6-Rp\cdot\cos\theta p+L1\cdot\sin\phi1)/L3\}$ $d\phi1/dt=\omega\cdot\{R\cdot\cos(\theta-\phi3)-\eta\cdot Rp\cdot\cos(\theta p-\phi3)\}/\{L1\cdot\sin(\phi1+\phi3)\}$ An equation in a case where dX/d=0 in the above-described equation (2) has four solutions when $\theta$ is in a range of $-2\pi<\theta<2\pi$. The four solutions are associated with the motion of a 4-cycle engine, and crank angles providing a top dead center at the compression stroke, an top dead center at the intake and exhaust strokes, a bottom dead center after the expansion stroke and a bottom dead center after the intake stroke are determined and used to determine various positions of the piston pin. When the position of the piston pin 63 in the direction of the x-axis at the top dead center at the compression stroke is represented by Xctdc; the position of the piston pin 63 in the direction of the x-axis at the top dead center at the intake and exhaust strokes is represented by Xotdc; the position of the piston pin 63 in the direction of the x-axis at the bottom dead center after the expansion stroke is represented by Xebdc; and the position of the piston pin 63 in the direction of the x-axis at the bottom dead center after the intake stroke is represented by Xibdc, the stroke Scomp at the compression stroke and the stroke Sexp at the expansion stoke are represented by (Scomp=Xctdc−Xibdc) and (Sexp=Xotdc−Xebdc), respectively, and the following dimensions are determined, so that Scomp<Sexp is satisfied and Xctdc=Xotdc is satisfied: the length L1 of the second arm 67; the length L2 of the first arm 66; the length L3 of the control rod 69; the length L4 of the connecting rod 64; the length L5 from the axis of the crankshaft 27 to the axes of the rotary shafts 81 and 82 in the direction of the y-axis; the length L6 from the axis of the crankshaft 27 to the axes of the rotary shafts 81 and 82 in the direction of the x-axis; the amount $\delta$ of offsetting of the cylinder axis C from the axis of the crankshaft 27 in the direction of the y-axis; the angle $\alpha$ formed by the first and second arms 66 and 67; the length R between the axis of the crankshaft 27 and the crankpin 65; the length Rp of the straight line connecting the axes of the rotary shafts 81 and 82 and the axis of the movable eccentric shaft 61 and the angle $\theta p$ when the angle $\theta$ is "0".

Such determinations ensure that the stroke of the piston at the expansion stroke is larger than that at the compression stroke and moreover, the top dead center at the intake and exhaust strokes and the top dead center at the compression stroke can be identical with each other.

Figure 6:
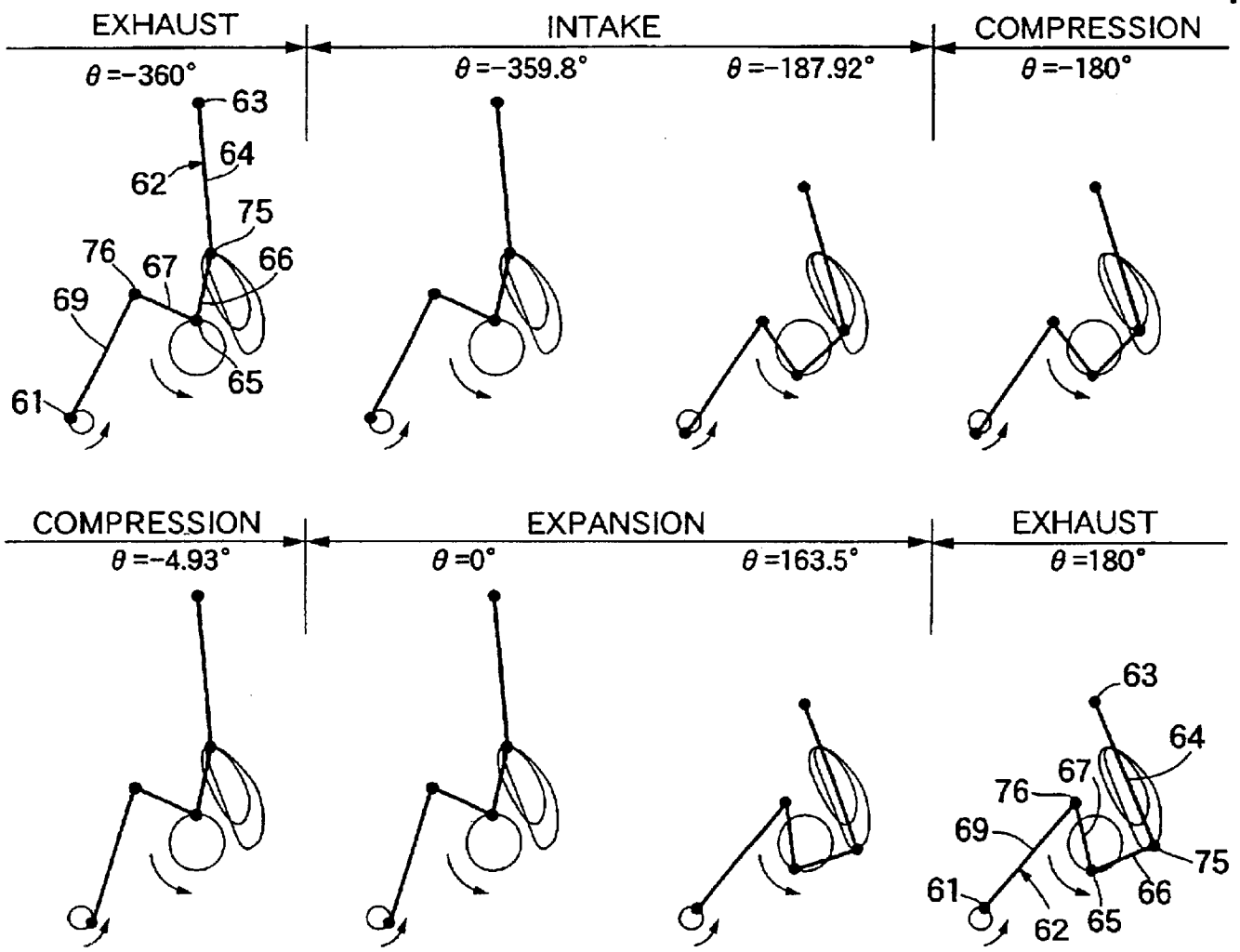
Figure 7:
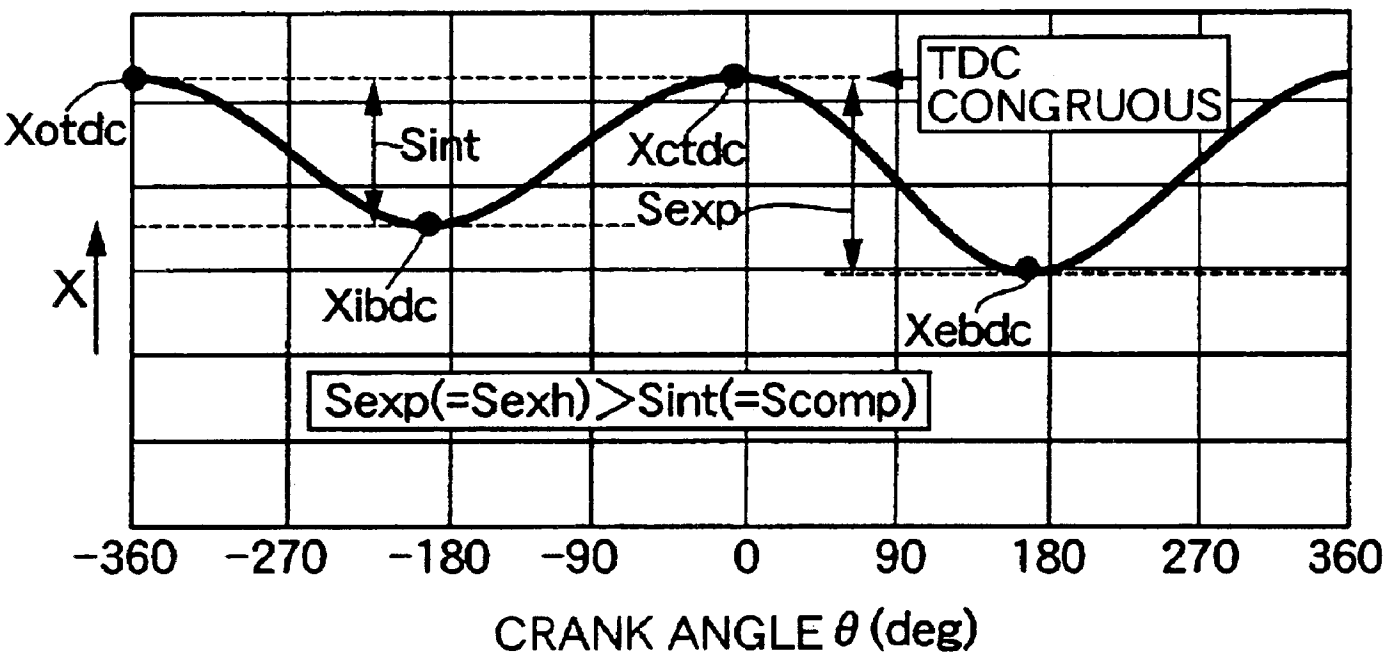

More specifically, the link mechanism 62 is operated as shown in FIG. 6 at the intake, compression, expansion and exhaust strokes in the engine, and the position X of the piston pin 63 in the direction of the x-axis is varied as shown in FIG. 7 in accordance with such operation of the link mechanism 62. Namely, the stroke Sint at the intake stroke and the stroke Scomp at the compression stroke are equal to each other (Sint=Scomp), and the stroke Sexp at the expansion stroke and the stroke Sexh at the exhaust stroke are equal to each other (Sexp=Sexh). Moreover, the stroke Sexp (=Sexh) at the expansion stroke is larger than the stroke Scomp (=Sint) at the compression stroke. Thus, a larger expansion work can be conducted with the same amount of a fuel-air mixture drawn, thereby enhancing the cycle thermal efficiency.

Further, the position Xotdc of the piston pin 63 in the direction of the X-axis at the top dead center at the intake and exhaust strokes and the position Xctdc of the piston pin 63 in the direction of the X-axis at the top dead center at the compression stroke are also congruous with each other.

The operation of the first embodiment will be described below. The engine includes the link mechanism which is constituted by the connecting rod 64 connected at one end to the piston 38 through the piston pin 63, the first arm 66 turnably connected at one end to the other end of the connecting rod 64 and at the other end to the crankshaft 27 through the crankpin 65, the second arm 66 integrally connected at one end to the other end of the first arm to constitute the subsidiary rod 68 by cooperation of the first arm, and the control rod 69 turnably connected at one end to the other end of the second arm 67. The movable eccentric shaft 61 for supporting the other end of the control rod 69 is mounted between the eccentric positions of the rotary shafts 81 and 82 to which the power reduced at the reduction ratio of 1/2 is transmitted from the crankshaft 27, and the stroke of the piston 38 at the expansion stroke is larger than that at the compression stroke. In such engine, the following various dimensions are determined properly: the length L1 of the second arm; the length L2 of the first arm 66; the length L3 of the control rod 69; the length L4 of the connecting rod 64; the length L5 from the axis of the crankshaft 27 to the axes of the rotary shafts 81 and 82 in the direction of the y-axis; the length L6 from the axis of the crankshaft 27 to the axes of the rotary shafts 81 and 82 in the direction of the x-axis; the amount $\delta$ of offsetting of the cylinder axis C from the axis of the crankshaft 27 in the direction of the y-axis; the angle α formed by the first and second arms 66 and 67; the length R between the axis of the crankshaft 27 and the crankpin 65; the length Rp of the straight line connecting the axes of the rotary shafts 81 and 82 and the axis of the movable eccentric shaft 61 and the angle θp when the angle θ is "0", so that the top dead center at the intake and exhaust strokes and the top dead center at the compression stroke are congruous with each other.

Therefore, it is possible to prevent the occurrence of interferences of the intake valve 43 and the exhaust valve 44 and the top of the piston 38 with each other and to provide an enhancement in compression ratio in the engine to achieve the operation of the engine at a higher thermal efficiency. It is also possible to achieve the sufficient scavenge by the piston 38 to prevent a reduction in output in a full-load state and prevent the instability of the combustion in a lower-load state.

The first and seconds arms 66 and 67 constitute the subsidiary rod 68 having the semi-circular first bearing portion 70 placed into sliding contact with the half of the periphery of the crankpin 65 by cooperation with each other. The connecting rod 64 is turnably connected to one end of the subsidiary rod 68, and the control rod 69 is turnably connected at one end to the other end of the subsidiary rod 68. The crank cap 73 having the semi-circular bearing portion 74 placed into sliding contact with the remaining half of the periphery of the crankpin 65 is fastened to the pair of semi-circular bifurcated portions 71 and 72 integrally provided on the subsidiary rod 68 in such a manner that the other end of the connecting rod 64 and the one end of the control rod 69 are sandwiched between the semi-circular bifurcated portions 71 and 72. Thus, it is possible to enhance the rigidity of the subsidiary rod 68 mounted to the crankpin 65.

In addition, the connecting rod pin 75 press-fitted into the other end of the connecting rod 64 is turnably fitted at its opposite ends into one 71 of the bifurcated portions, and the subsidiary rod pin 76 relatively rotatably passed through one end of the control rod 69 is clearance-fitted at its opposite ends into the other bifurcated portion 72. Therefore, the portion from the piston 38 to the subsidiary rod 68 and the control rod 69 are assembled separately into the engine, and the subsidiary rod 68 and the control rod 69 can be then connected to each other. In this manner, the assembling operation can be facilitated, while enhancing the assembling accuracy and as a result, an increase in size of the engine can be avoided.

Moreover, since the connecting rod pin 75 and the subsidiary rod 76 are disposed on the extensions of the axes of the bolts 78 for fastening the crank cap 73 to the subsidiary rod 68, the subsidiary rod 68 and the crank cap 73 can be constructed compactly, whereby the weight of the subsidiary rod 68 and the crank cap 73 can be reduced, and the loss of a power can be also suppressed.

Figure 8:
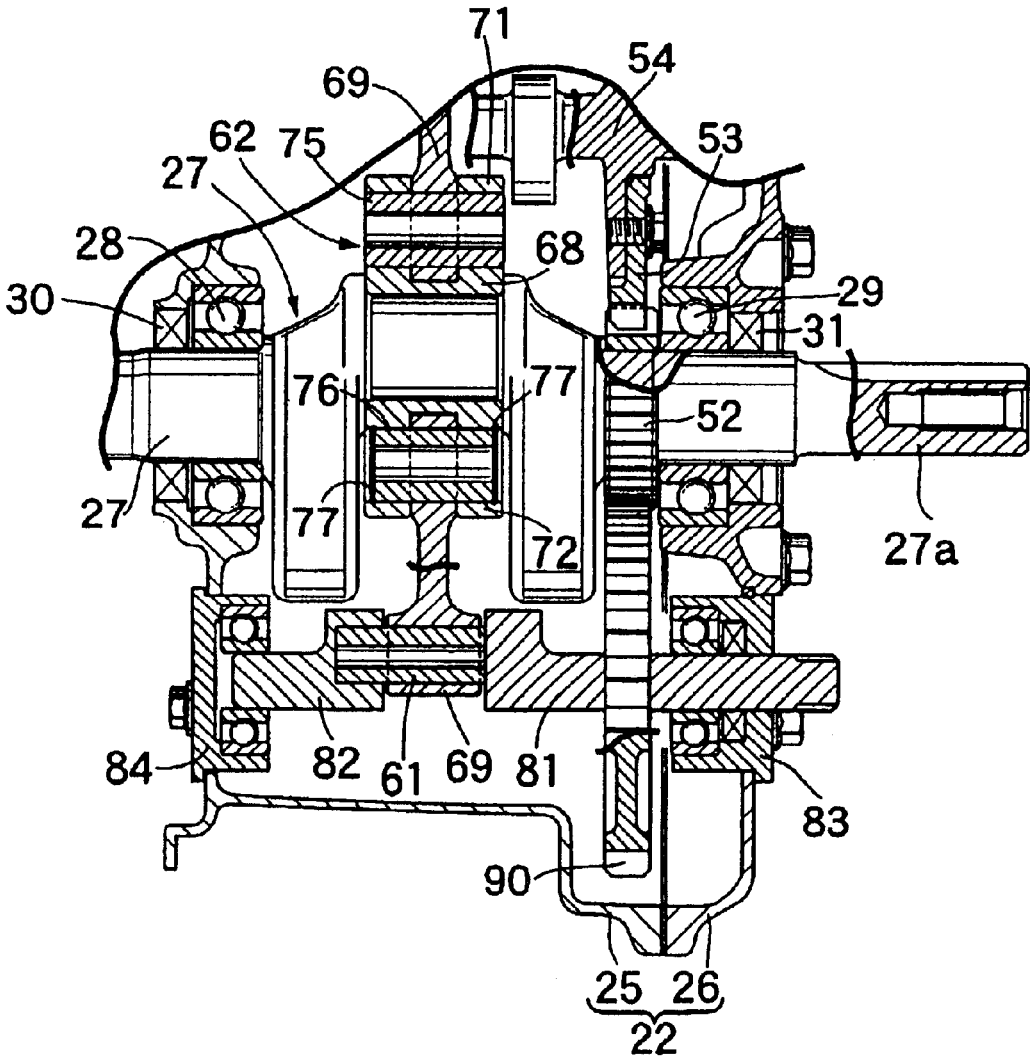
FIG. 8 is a sectional view of essential portions of an engine according to a second embodiment.

FIG. 8 shows a second embodiment of the present invention, wherein portions or components corresponding to those in the first embodiment are designated by the same reference numerals and symbols.

A driven gear 90 fixed to the rotary shaft 81 is meshed with a driving gear 52 which is provided on the crankshaft 27, so that it is meshed with the driven fear 53 fixed to the camshaft 54. Thus, a rotational power reduced at a reduction ratio of 1/2 is transmitted from the crankshaft 27 through the driving gear 52 and the driven gear 90 to the rotary shafts 81 and 82, and the movable eccentric shaft 61 mounted between the rotary shafts 81 and 82 is rotated about the axes of the rotary shafts 81 and 82 in one rotation every time the crankshaft 27 is rotated in two rotations.

Moreover, the movable eccentric shaft 61 of the second embodiment rotates in the direction opposite to that the movable eccentric shaft 61 of the first embodiment rotates. That is, in the second embodiment, rotational direction of the movable eccentric shaft 61 is represented by $\eta=-0.5$ when its rotational speed is η.

Also in the second embodiment, the top dead center at the intake and exhaust strokes and the top dead center at the compression stroke can be made congruous with each other to provide an effect similar to that in the first embodiment by properly determining the length L1 of the second arm 67; the length L2 of the first arm 66; the length L3 of the control rod 69; the length L4 of the connecting rod 64; the length L5 from the axis of the crankshaft 27 to the axes of the rotary shafts 81 and 82 in the direction of the y-axis; the length L6 from the axis of the crankshaft 27 to the axes of the rotary shafts 81 and 82 in the direction of the x-axis; the amount δ of offsetting of the cylinder axis C from the axis of the crankshaft 27 in the direction of the y-axis; the angle a formed by the first and second arms 66 and 67; the length R between the axis of the crankshaft 27 and the crankpin 65; the length Rp of the straight line connecting the axes of the rotary shafts 81 and 82 and the axis of the movable eccentric shaft 61 and the angle θp when the angle θ is "0".

When the piston 38 is at the expansion stroke, a large load is applied to the piston 38 due to the combustion in the combustion chamber 40, but if the change in attitude of the piston 38 is increased due to the large load at that time, the friction is increased and the piston slap sound is magnified. Therefore, an arrangement designed to prevent such disadvantage from being arisen will be described in a third embodiment.

To suppress the friction and the piston slap sound, a locus of movement of the piston pin 63 is determined to be fallen into a range between the x-axis and one (which is closest to the x-axis) of tangent lines parallel to the x-axis and tangent to a locus described at the expansion and compression strokes by a point of connection between the connecting rod 64 and the first arm 66, i.e., the center of the connecting rod pin 75.

Figure 9:
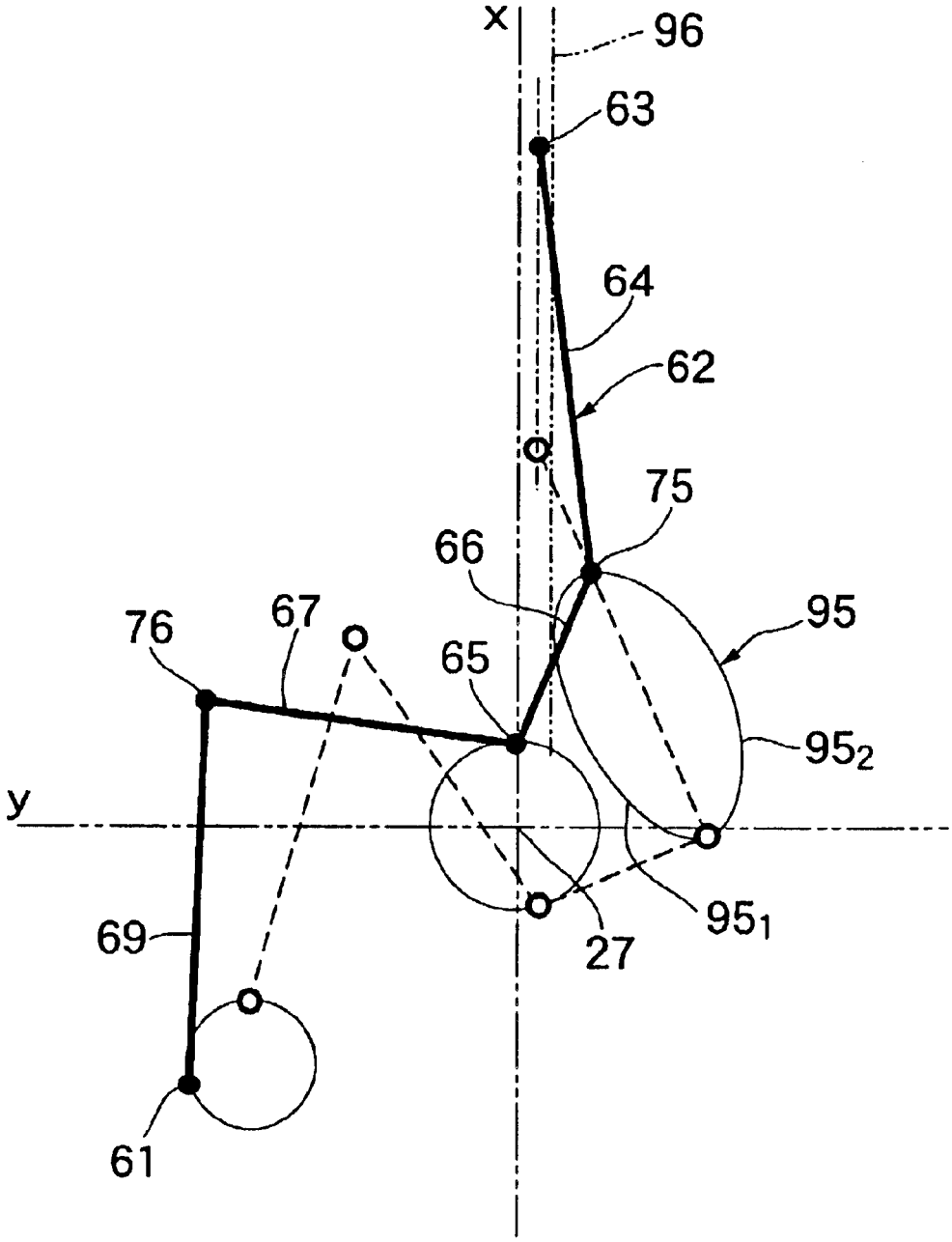
FIG. 9 is an illustration showing the state of a link mechanism at expansion stroke in a third embodiment.

More specifically, at the expansion and exhaust strokes, the link mechanism 62 is operated as shown in FIG. 9 between a state in which the piston 38 is at the top dead center (a state shown by a solid line) and a state in which the piston 38 is at the bottom dead center (a state shown by a dashed line), and the center of the connecting rod pin 75 describes a locus $\mathbf{95}_1$ shown by a thin solid line at the expansion stroke and describes a locus $\mathbf{95}_2$ shown in a thin solid line at the next exhaust stroke, so that a locus 95 provides an endless configuration as a whole. The locus of movement of the piston pin 63 is determined to be fallen into a range between the x-axis and one 96 of a pair of tangent lines parallel to the x-axis and tangent to the locus 951 at the expansion stroke, which is closest to the x-axis.

If the locus of movement of the piston pin 63 is determined as described above, the friction of the piston 38 can be reduced, and the piston slap sound can be suppressed. More specifically, when the piston 38 is at the expansion stroke, a large load is applied to the piston 38, but if the change in attitude of the piston 38 is increased due to the large load at that time, the friction is increased and the piston slap sound is magnified. However, the above-described determination of the locus of movement of the piston pin 63 ensures that the connecting rod 64 is always inclined to one side at the expansion stroke, notwithstanding that the piston 38 receives the large load at the expansion stroke, whereby the change in attitude of the piston 38 can be suppressed. As a result, the friction of the piston 38 can be reduced, and the piston slap sound can be suppressed.

In the engine in which during lowering of the piston 38, the stroke at the expansion stroke is larger than that at the intake stroke, and during lifting of the piston 38, the stroke at the exhaust stroke is larger than that at the compression stroke, as described above, if the link mechanism is set so that the top and bottom dead centers of the piston 38 are retracted at every crank angle of 180 degrees, there is a possibility that the reciprocating speed of the piston at the expansion and exhaust strokes at which the stroke is larger is larger than the reciprocating speed of the piston 38 at the intake and compression strokes at which the stroke is smaller, and the change in acceleration of the piston at the top and bottom dead centers is magnified due to such a speed difference, thereby bringing about a degradation of inertial vibration. Thus, in the engine using the above-described link mechanism 62, the range of the crank angle at each of the intake, compression, expansion and exhaust strokes can be set at a value other than 180 degrees.

Figure 10:
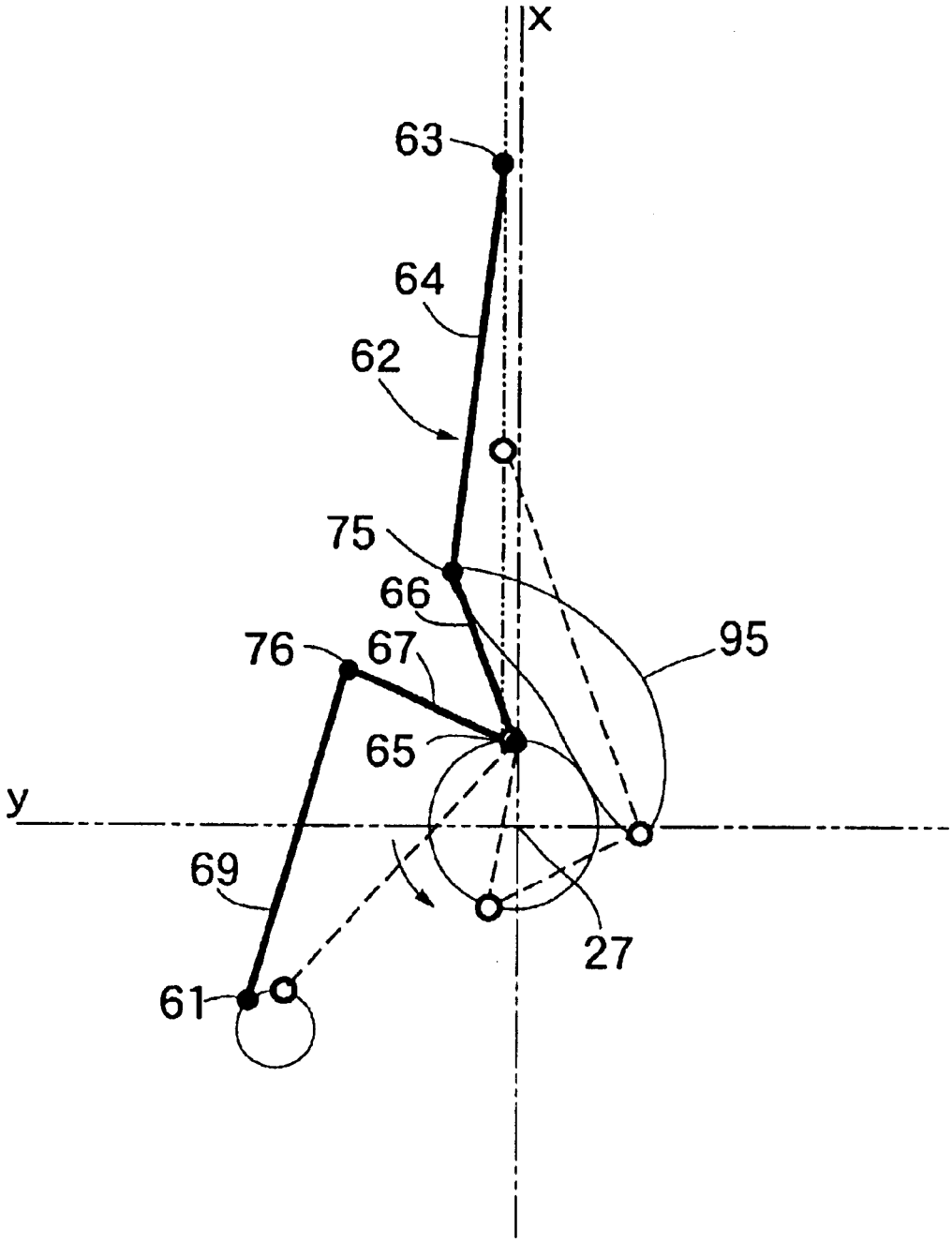
FIG. 10 is an illustration showing the state of the link mechanism at the expansion stroke when a range of crank angle at each of the intake and compression strokes is set larger than that each of the expansion and exhaust strokes.
Figure 11:
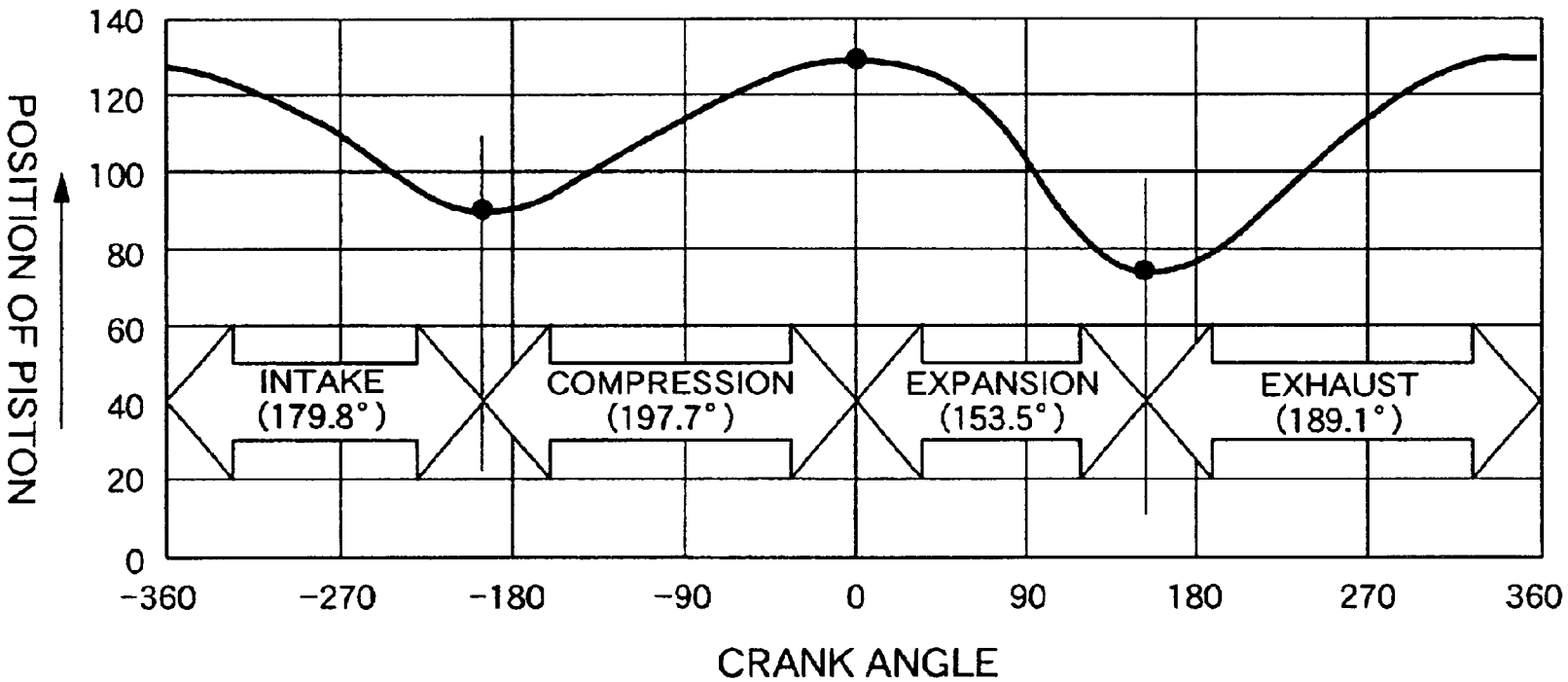
FIG. 11 is a graph showing the position of a piston provided at each of the strokes by the link mechanism shown in FIG. 10.

For example, when the link mechanism 62 is set so that it is brought into a state shown by a solid line in FIG. 10 at the top dead center at the expansion stroke and a state shown by a dashed line in FIG. 10 at the bottom dead center, the range of the crank angle at each of the intake, compression, expansion and exhaust strokes is as shown in FIG. 11. The range (=179.8 degrees) of the crank angle at the intake stroke is larger than the range (=153.5 degrees) of the crank angle at the expansion stroke, and the range (=197.7 degrees) of the crank angle at the compression stroke is larger than range (=189.1 degrees) of the crank angle at the exhaust stroke, and the acceleration of the piston 38 in this case is varied as shown in FIG. 12.

Figure 12:
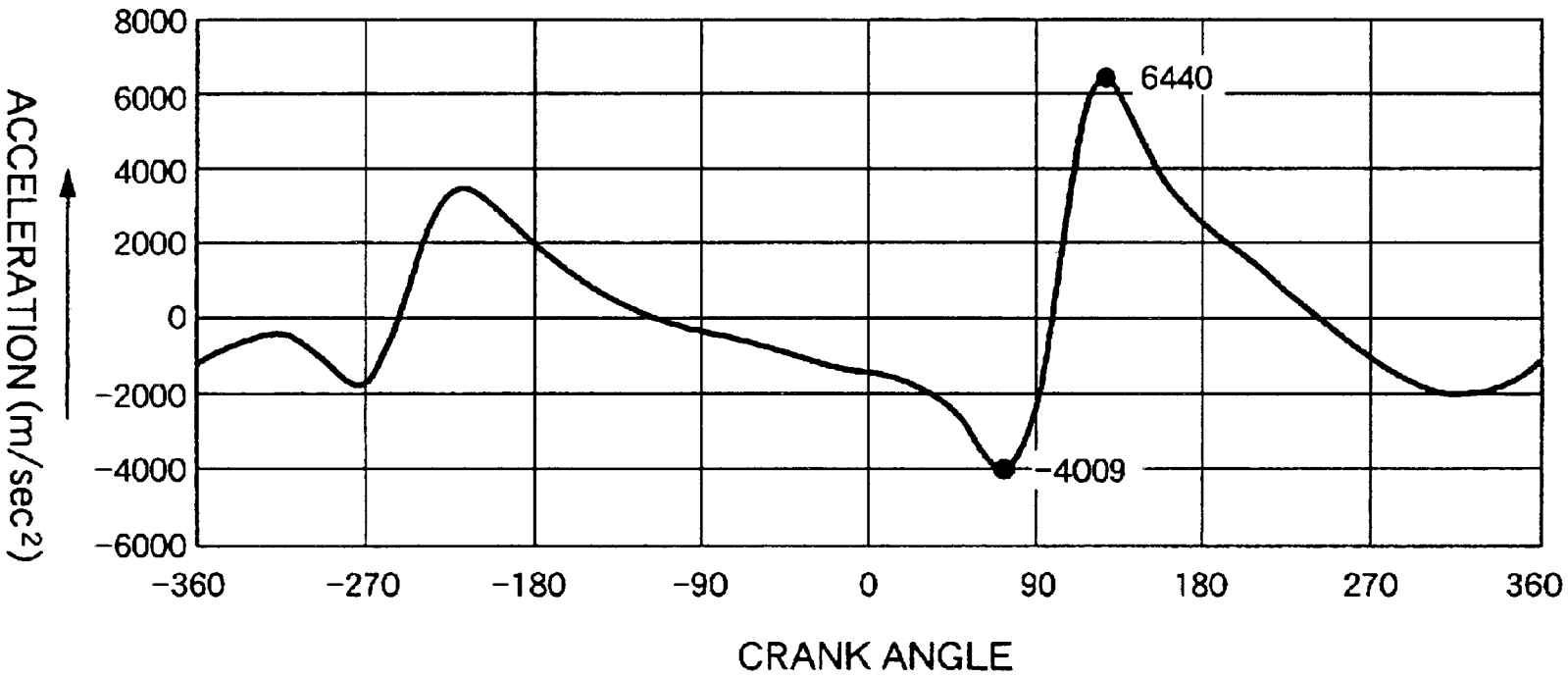
FIG. 12 is a graph showing a variation in acceleration of the piston provided at each of the strokes by the link mechanism shown in FIG. 10.

In this case, when the stroke of the piston 38 at the expansion and exhaust strokes is 56 mm; the stroke of the piston 38 at the intake and compression strokes is 37 mm; and a ratio of the volume at the expansion stroke to the volume at compression strokes is 1.5, the largest acceleration (the largest acceleration toward the top dead center) is +6440 m/sec$^2$ immediately before the expansion stroke changes to the exhaust stroke; the smallest acceleration (the largest acceleration toward the bottom dead center) is −4009 m/sec$^2$ in the middle of the expansion stroke, as shown in FIG. 12, and both (the absolute value of the largest acceleration) and (the absolute value of the smallest acceleration) are large.

Namely, if the range of the crank angle at the intake stroke is larger than the range of the crank angle at the expansion stroke, and the range of the crank angle at the compression stroke is larger than the range of the crank angle at the exhaust stroke, the acceleration of the piston 38 is not reduced and hence, it is impossible to prevent the degradation of inertia vibration.

Therefore, in a fourth embodiment of the present invention, the range of the crank angle at the expansion stroke is set larger than the range of the crank angle at the intake stroke, and the range of the crank angle at the exhaust stroke is set larger than the range of the crank angle at the compression stroke.

Figure 13:
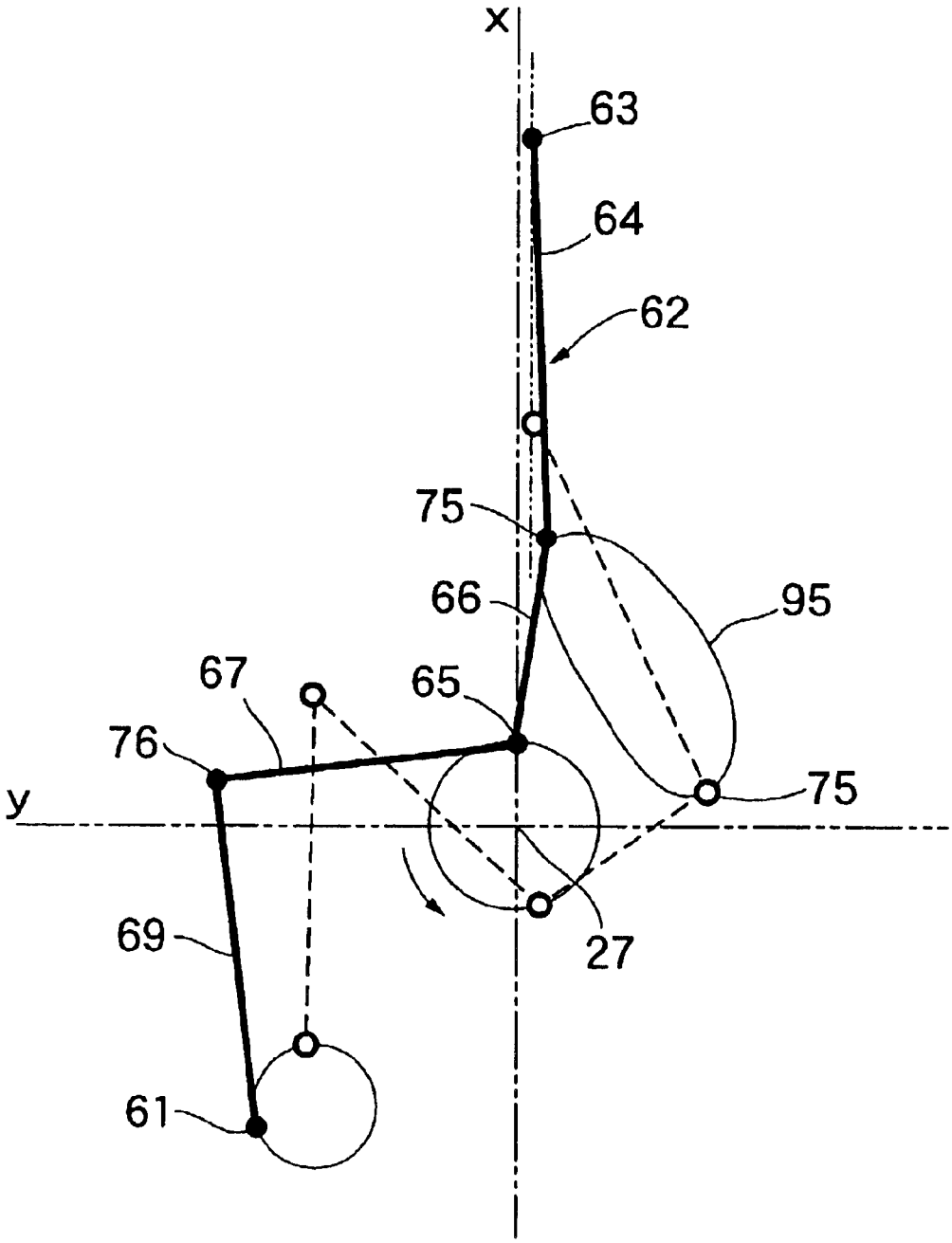
FIG. 13 is an illustration showing a state of a link mechanism at expansion stroke in a fourth embodiment.
Figure 14:
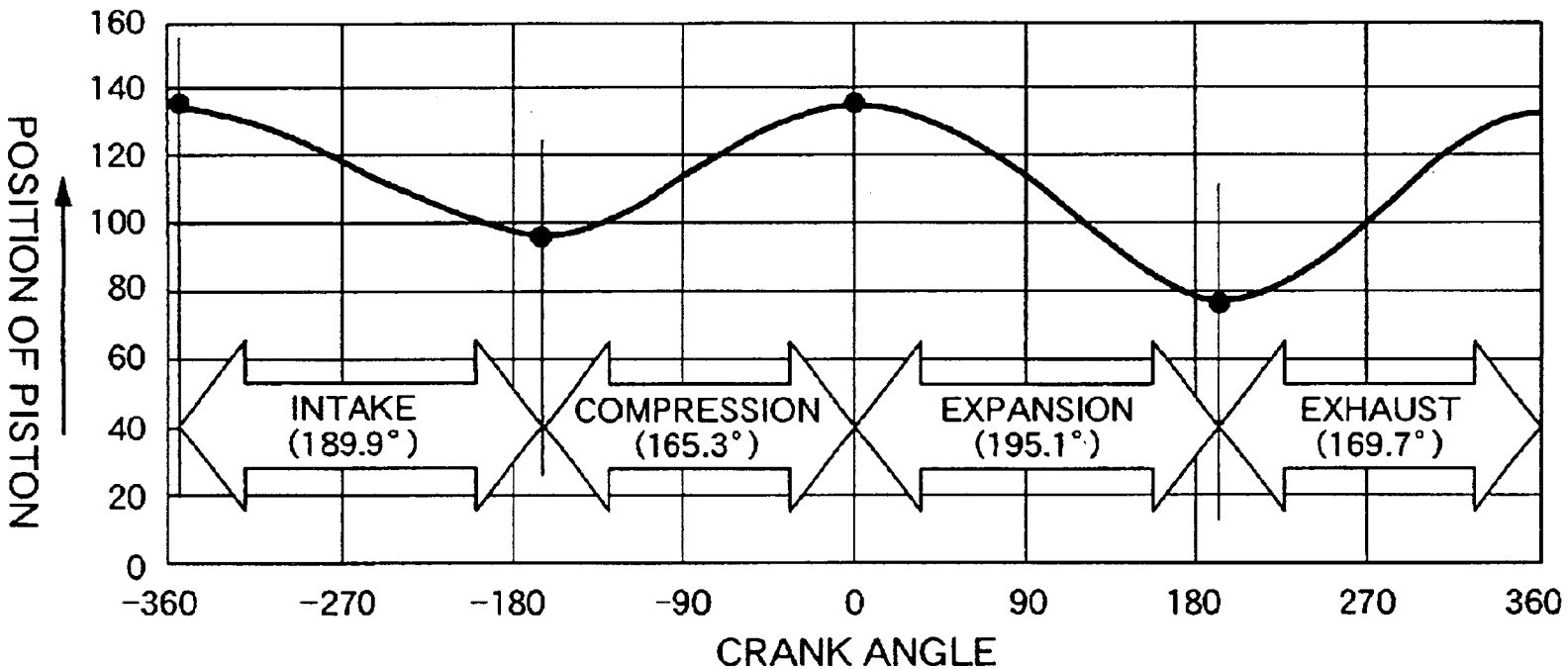
FIG. 14 is a graph showing the position of a piston provided at each of the strokes by the link mechanism shown in FIG. 13.

Namely, when the link mechanism 62 is set so that it is brought into a state shown by a solid line in FIG. 13 at the top dead center at the expansion stroke, and a state shown by a dashed line in FIG. 13 at the bottom dead center, the range of the crank angle at each of the intake, compression, expansion and exhaust strokes is as shown in FIG. 14. The range (=195.1 degrees) of the crank angle at the expansion stroke is larger than range (=189.9 degrees) of the crank angle at the intake stroke, and the range (=169.7 degrees) of the crank angle at the exhaust stroke is larger than range (=165.3 degrees) of the crank angle at the compression stroke, and the acceleration of the piston 38 in this case is varied as shown in FIG. 15.

Figure 15:
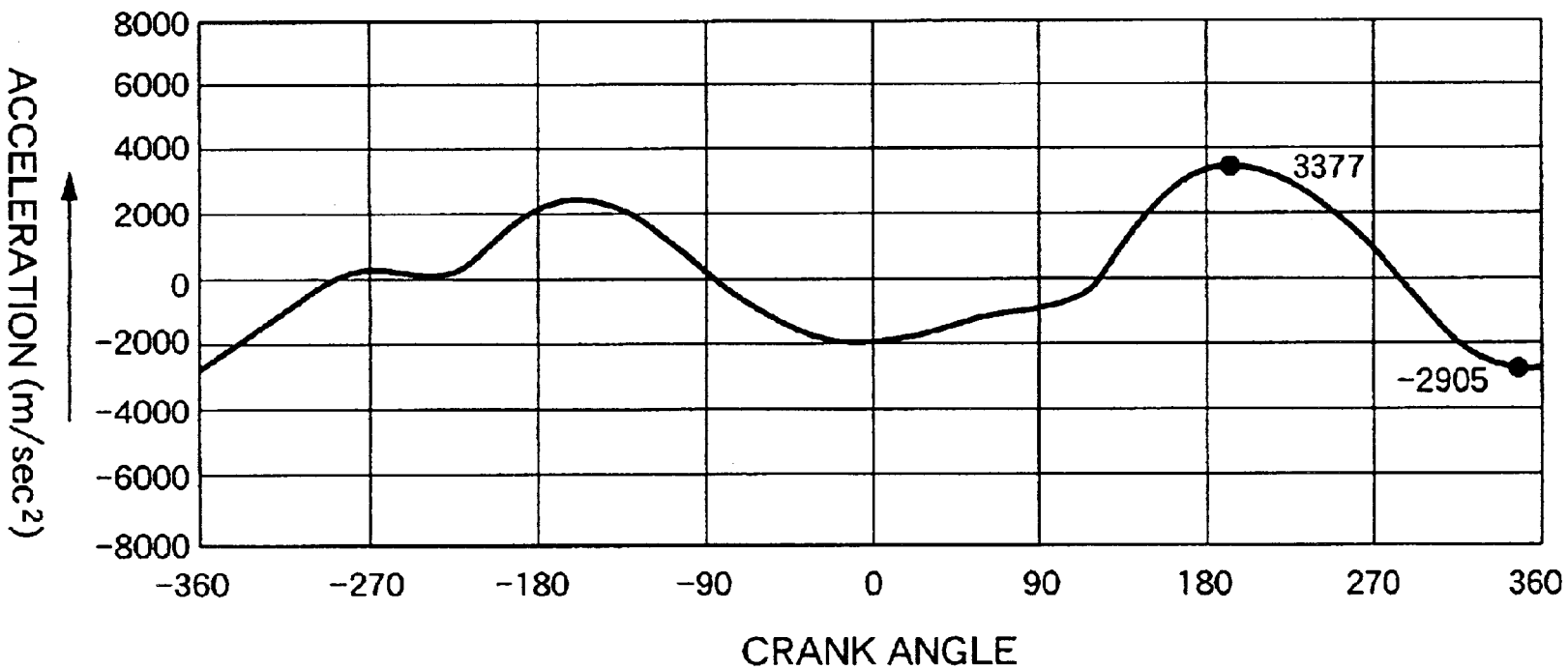
FIG. 15 is a graph showing a variation in acceleration of the piston provided at each of the strokes by the link mechanism shown in FIG. 13.

In this case, when the stroke of the piston 38 at the expansion and exhaust strokes, the stroke of the piston 38 at the intake and compression strokes and the ratio of the volume at the expansion stroke to the volume at the compression stroke are set at the same values in the embodiment shown in FIGS. 10 to 12, the largest acceleration (the largest acceleration toward the top dead center) is +3377 m/sec$^2$ at the time when the expansion stroke changes to the exhaust stroke; the smallest acceleration (the largest acceleration toward the bottom dead center) is −2909 m/sec$^2$ immediately before the exhaust stroke changes to the intake stroke, as shown in FIG. 15, and both (the absolute value of the largest acceleration) and (the absolute value of the smallest acceleration) can be reduced remarkably than those in the embodiment shown in FIGS. 10 to 12.

Namely, by setting the range of the crank angle at the expansion and exhaust strokes at which the stroke is larger at a value larger than the range of the crank angle at the intake and compression strokes at which the stroke is smaller, the speed of the piston 38 at each of the strokes can be uniform, and the variation in acceleration of the piston at the bottom dead center after the intake and expansion strokes and the variation in acceleration of the piston at the top dead center after the compression and exhaust strokes can be suppressed, thereby avoiding the degradation of inertia vibration.

Figure 16:
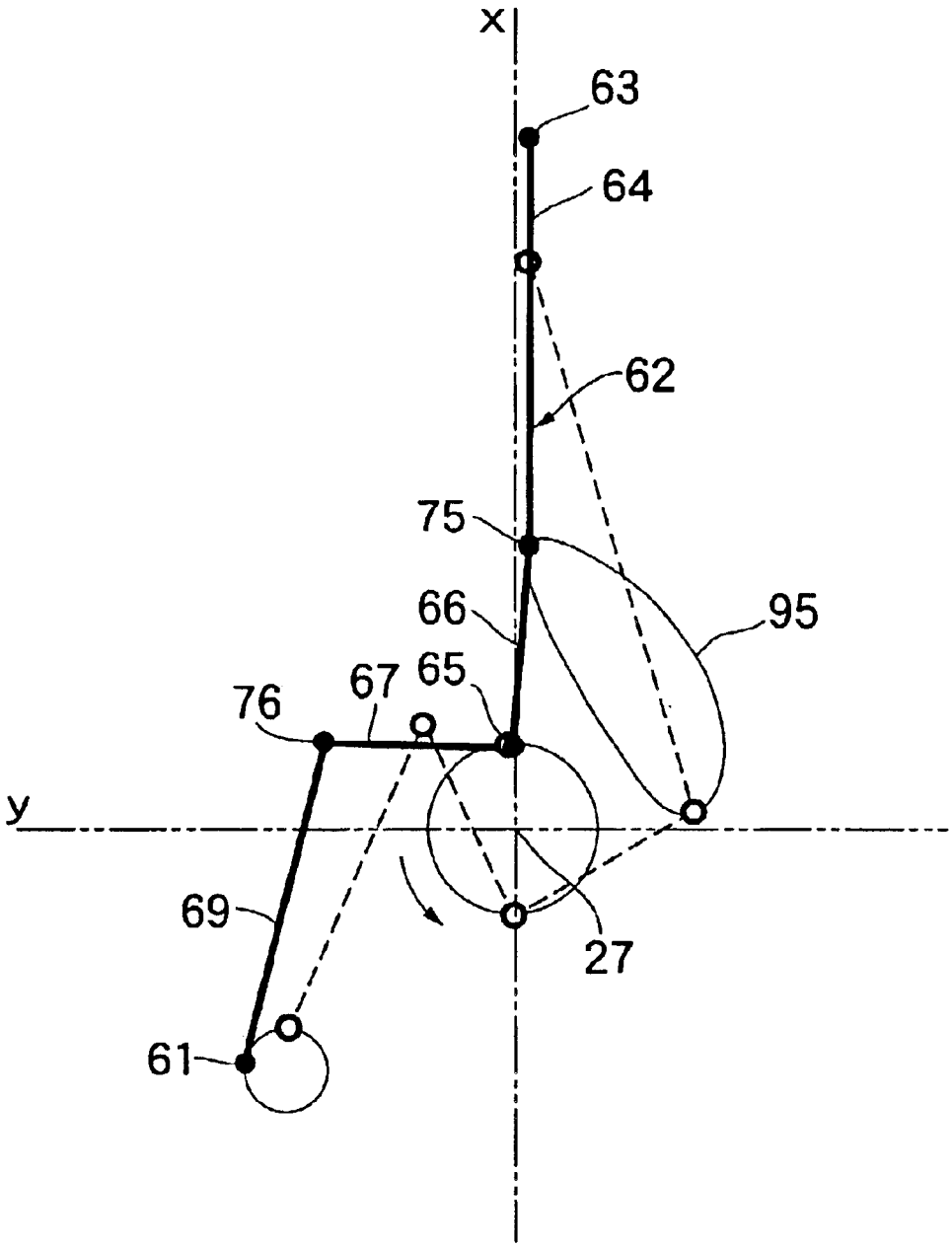
FIG. 16 is an illustration showing a state of a link mechanism at expansion stroke in a fifth embodiment.
Figure 17:
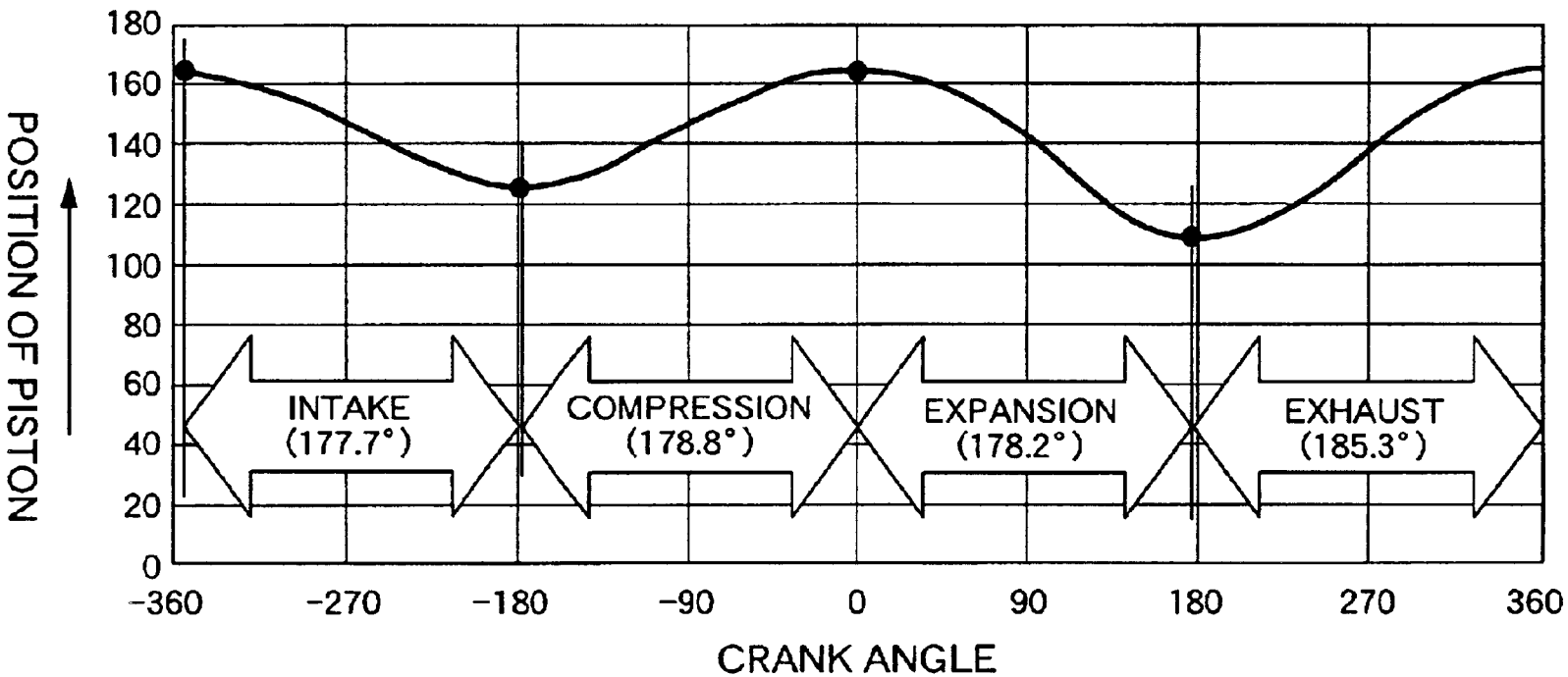
FIG. 17 is a graph showing the position of a piston provided at each of the strokes by the link mechanism shown in FIG. 16.

In addition, in a fifth embodiment of the present invention, the link mechanism 62 is set so that it is brought into a state shown by a solid line in FIG. 16 at the top dead center at the expansion stroke, and a state shown by a dashed line in FIG. 16 at the bottom dead center. Thus, the range of the crank angle at each of the intake, compression, expansion and exhaust strokes is as shown in FIG. 17. The range of the crank angle at the expansion stroke (=178.2 degrees) is larger than the range of the crank angle at the intake stroke (=177.7 degrees), and the range of the crank angle at the exhaust stroke (=185.3 degrees) is larger than the range of the crank angle at the compression stroke (=178.8 degrees), and the acceleration of the piston 38 in this case is varied as shown in FIG. 18.

Figure 18:
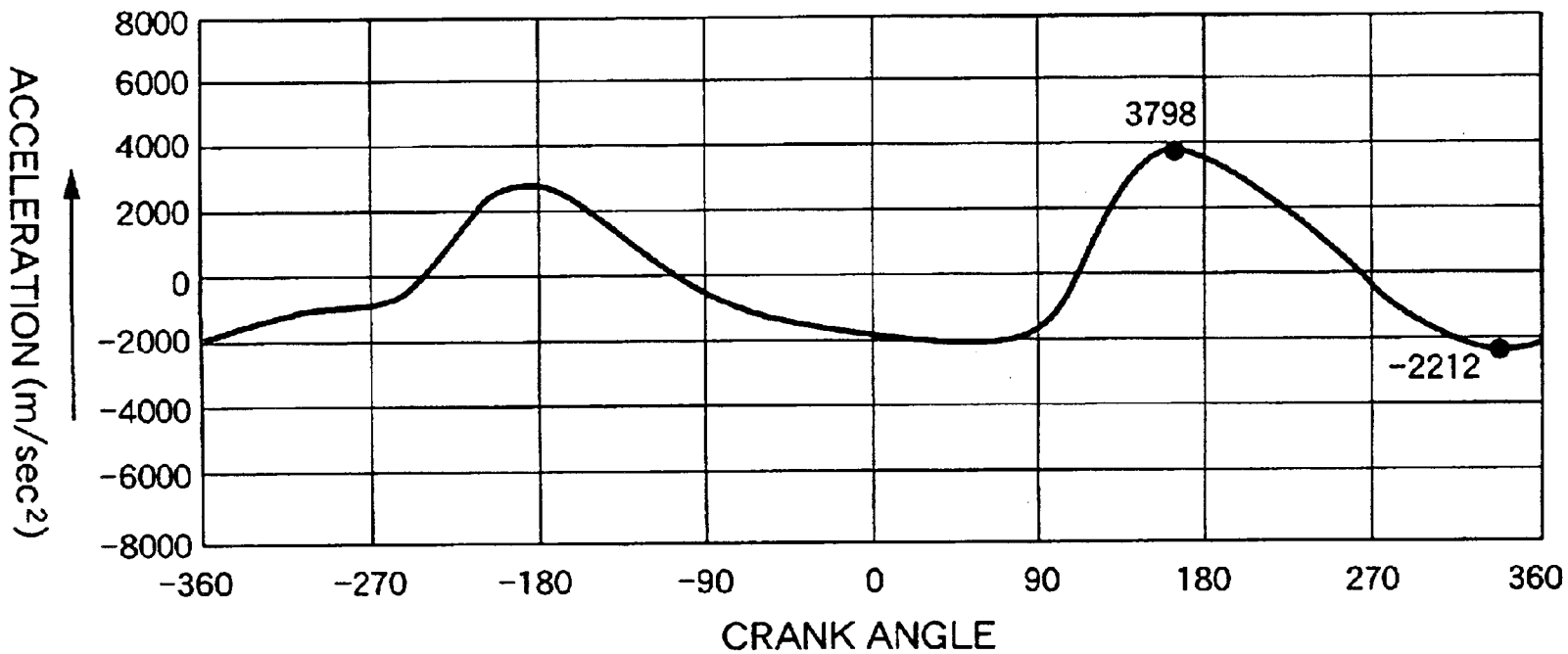
FIG. 18 is a graph showing a variation in acceleration of the piston provided at each of the strokes by the link mechanism shown in FIG. 16.

In this case, when the stroke of the piston 38 at the expansion and exhaust strokes, the stroke of the piston 38 at the intake and compression strokes and the ratio of the volume at the expansion stroke to the volume at the compression stroke are set at the same values in the embodiment shown in FIGS. 10 to 12 and the fourth embodiment, the largest acceleration (the largest acceleration toward the top dead center) is +3798 m/sec$^2$ at the time when the expansion stroke changes to the exhaust stroke; the smallest acceleration (the largest acceleration toward the bottom dead center) is −2212 m/sec$^2$ immediately before the exhaust stroke changes to the intake stroke, as shown in FIG. 18, and both (the absolute value of the largest acceleration) and (the absolute value of the smallest acceleration) can be reduced remarkably than those in the embodiment shown in FIGS. 10 to 12.

Also according to the fifth embodiment, the degradation of inertia vibration can be prevented as in the fourth embodiment.

In the fourth and fifth embodiments, however, the acceleration of the piston 38 can be reduced, but the largest acceleration (the largest acceleration toward the top dead center) and the smallest acceleration (the largest acceleration toward the bottom dead center) are imbalanced between the fourth and fifth embodiments. More specifically, in the fourth embodiment, (the absolute value of the largest acceleration)/(the absolute value of the smallest acceleration) is 1.16, and in the fifth embodiment it is 1.72. To reliably prevent the degradation of inertia vibration, it is desirable that (the absolute value of the largest acceleration)/(the absolute value of the smallest acceleration) is a value near to "1".

The reason why (the absolute value of the largest acceleration)/(the absolute value of the smallest acceleration) is larger than "1" in the fourth and fifth embodiment is considered to be that in the fourth embodiment, the range of the crank angle at the expansion stroke is 195.1 degrees exceeding 180 degrees, while the range of the crank angle at the exhaust stroke is 169.7 degrees smaller than 180 degrees, and in the fifth embodiment, the range of the crank angle at the exhaust stroke is 185.3 exceeding 180 degrees, while the range of the crank angle at the expansion stroke is 178.2 degrees smaller than 180 degrees.

Therefore, in a sixth embodiment of the present invention, the range of the crank angle at the expansion stroke is set larger than the range of the crank angle at the intake stroke, and the range of the crank angle at the exhaust stroke is set larger than the range of the crank angle at the compression stroke, and in addition, the ranges of the crank angles at the expansion and exhaust strokes are set at values exceeding 180 degrees, respectively.

Figure 19:
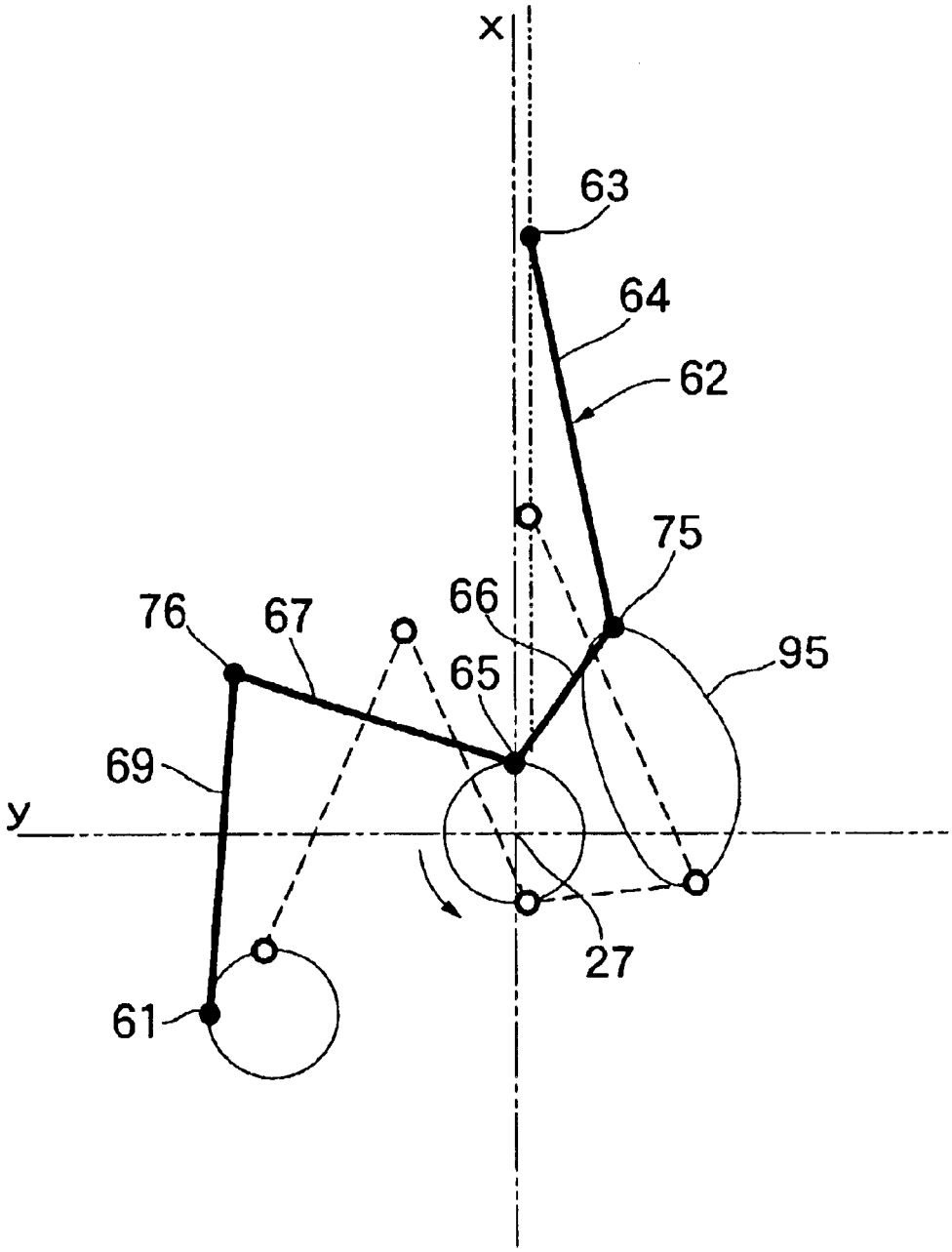
FIG. 19 is an illustration showing a state of a link mechanism at expansion and exhaust strokes in a sixth embodiment.
Figure 20:
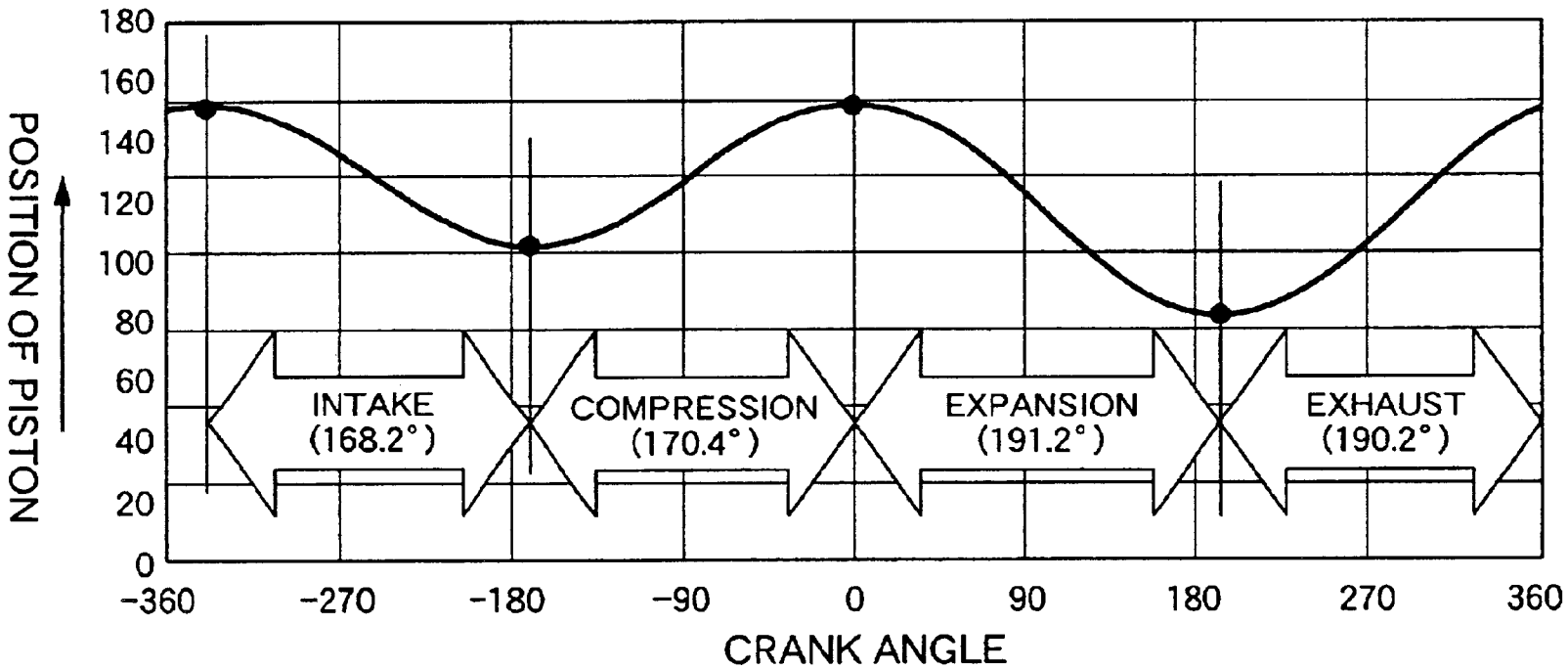
FIG. 20 is a graph showing the position of a piston provided at each of the strokes by the link mechanism shown in FIG. 19.

Namely, the link mechanism 62 is set so that it is brought into a state, for example, shown by a solid line in FIG. 19 at the top dead center at the expansion stroke and a state, for example, shown by a dashed line in FIG. 19 at the bottom dead center. Thus, the range of the crank angle at each of the intake, compression, expansion and exhaust strokes is as shown in FIG. 20. The range of the crank angle at the expansion stroke (=191.2 degrees) is larger than the range of the crank angle at the intake stroke (=168.2 degrees), and the range of the crank angle at the exhaust stroke (=190.2 degrees) is larger than the range of the crank angle at the compression stroke (=170.4 degrees), and the acceleration of the piston 38 in this case is varied as shown in FIG. 21.

According to the sixth embodiment, the speed of the piston 38 at each of the strokes can be further uniform, and the variation in acceleration of the piston at the bottom dead center after the intake and expansion strokes and the variation in acceleration of the piston at the top dead center after the compression and exhaust strokes can be suppressed more effectively, thereby avoiding the degradation of inertia vibration more effectively.

Figure 21:
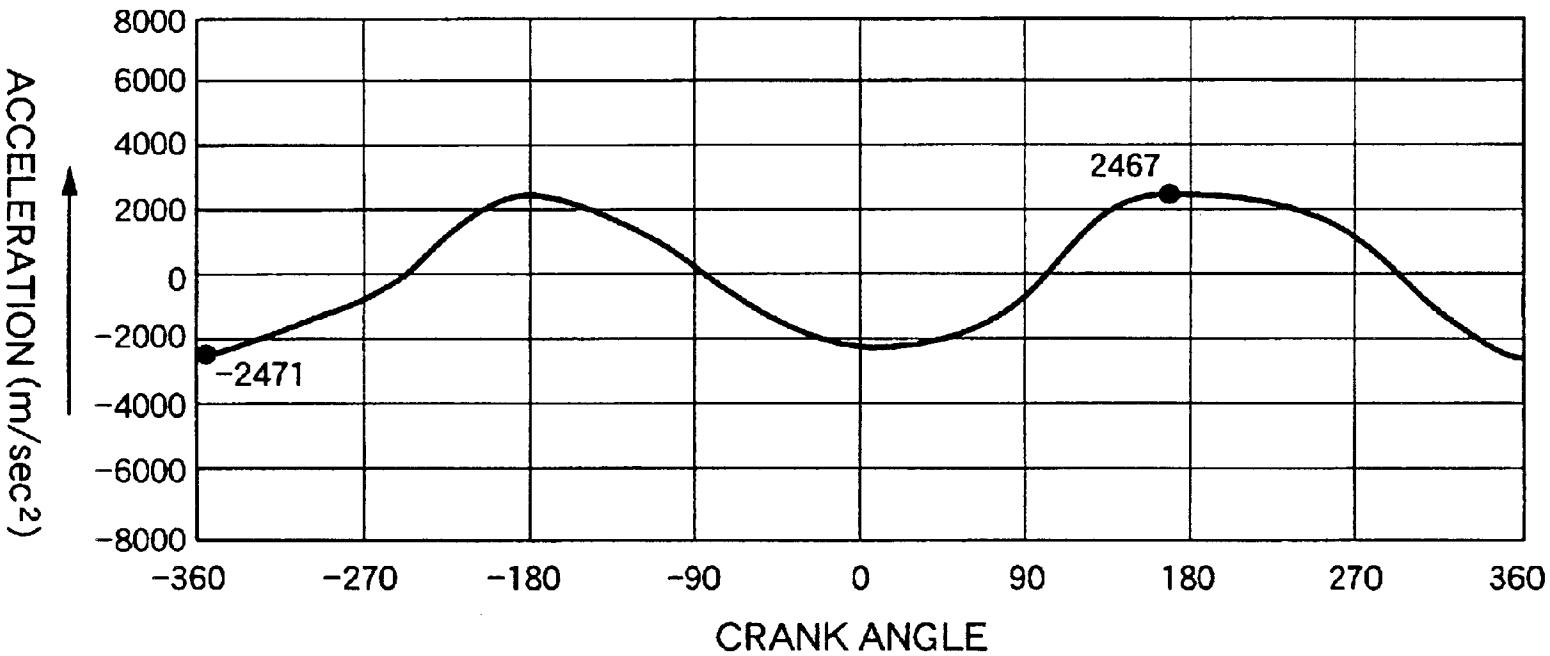
FIG. 21 is a graph showing a variation in acceleration of the piston provided at each of the strokes by the link mechanism shown in FIG. 19.

Namely, when the stroke of the piston 38 at the expansion and exhaust strokes, the stroke of the piston 38 at the intake and compression strokes and the ratio of the volume at the expansion stroke to the volume at the compression stroke are set at the same values in the embodiment shown in FIGS. 10 to 12, the largest acceleration (the largest acceleration toward the top dead center) is +2467 m/sec$^2$ immediately before the expansion stroke changes to the exhaust stroke; the smallest acceleration (the largest acceleration toward the bottom dead center) is −2471 m/sec$^2$ immediately before the exhaust stroke changes to the intake stroke, as shown in FIG. 21, and (the absolute value of the largest acceleration)/(the absolute value of the smallest acceleration) ≈1.0 can be achieved.

To ensure that the range of the crank angle at the expansion stroke is set larger than the range of the crank angle at the intake stroke, and the range of the crank angle at the exhaust stroke is set larger than the range of the crank angle at the compression stroke, and in addition, the ranges of the crank angles at the expansion and exhaust strokes are set at the values exceeding 180 degrees, respectively, the dimensions of the various portions in the link mechanism 62 are set as described below.

Figure 22:
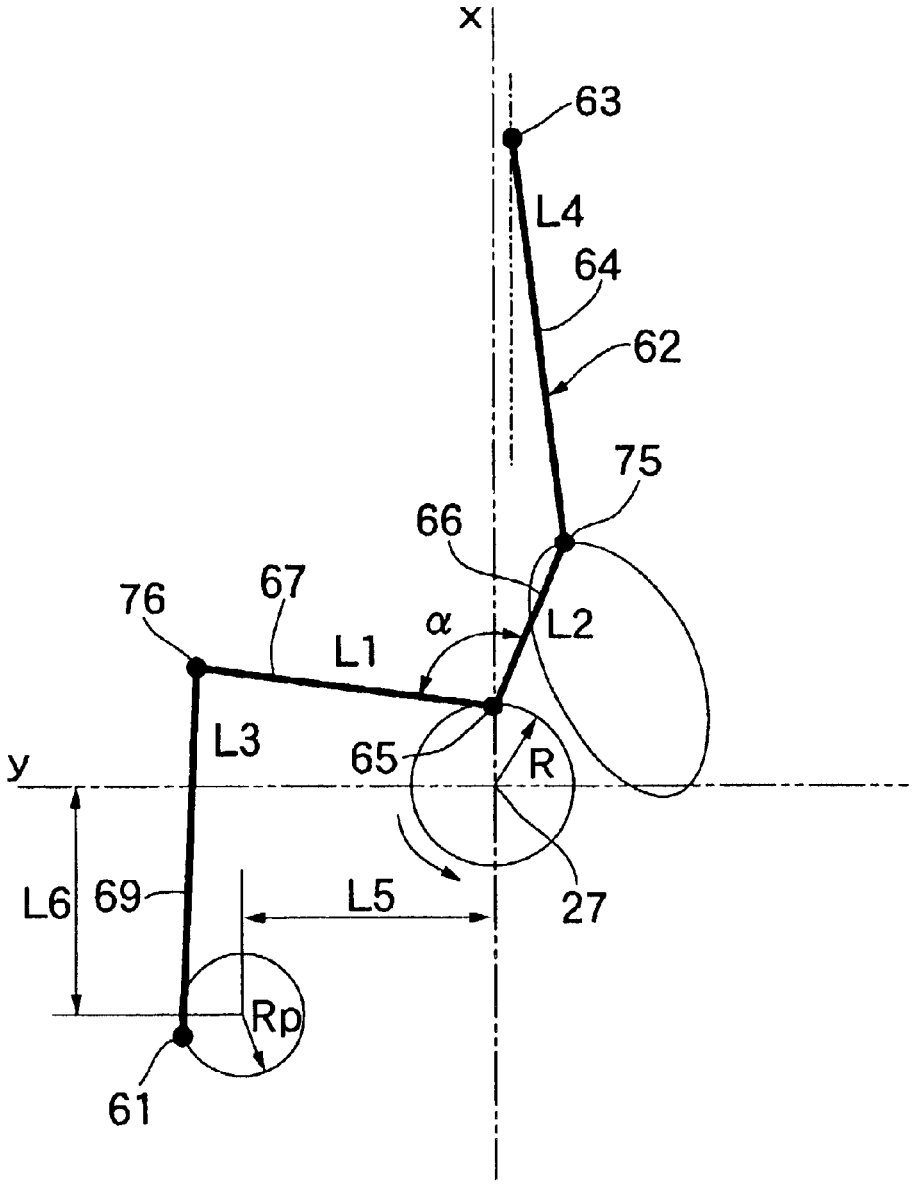
FIG. 22 is an illustration diagrammatically showing the disposition of a link mechanism for explaining dimensions of various portions.

As shown in FIG. 22, the support shaft 61 is displaced to describe a circular locus having a radius Rp about a point spaced within the x-y plane apart from the axis of the crankshaft 27 by the lengths L5 and L6 in the directions of the y-axis and the x-axis, respectively, and when the length R between the axis of the crankshaft 27 and the crankpin 65 is set at 1.0, the length L1 of the second arm 67 is set in a range of 1.7 to 4.5; the length L2 of the first arm 66 is set in a range of 0.6 to 5.2; the length L3 of the control rod 69 is set in a range of 4.3 to 6.9; the length L5 is set in a ranger of 2.3 to 4.0; the length L6 is set in a range of 0.00 to 3.35; and the radius Rp is set in a range of 0.25 to 1.80, as well as the angle a formed by the first and second arms 66, 67 is set in a range of 105 to 180 degrees.

By determining the dimensions of the various portions in the link mechanism 62, the degradation of inertia vibration can be avoided more effectively, as described in the sixth embodiment.

Although the embodiments of the present invention have been described in detail, it will be understood that the present invention is not limited to the above-described embodiments, and various modifications in design may be made without departing from the spirit and scope of the invention defined in the claims.

For example, the sprockets 85, 86 and the chain 87 have been used to turn the support shaft 61 in each of the above-described embodiments, but a cog belt or the like may be used.

What is claimed is:

1. An engine comprising a connecting rod connected at one end to a piston through a piston pin, a first arm turnably connected at one end to the other end of said connecting rod and at the other end to a crankshaft through a crankpin, a second arm integrally connected at one end to the other end of said first arm, a control rod turnably connected at one end to the other end of said second arm, and a movable eccentric shaft mounted between eccentric positions of rotary shafts to which a power reduced at a reduction ratio 1/2 is transmitted from said crankshaft, said movable eccentric shaft being connected to the other end of said control rod, the stroke of said piston at an expansion stroke being larger than that at a compression stroke, wherein when various dimensions are represented as described below in an x-y plane constituted by an x-axis extending through an axis of said crankshaft along a cylinder axis and a y-axis extending through the axis of said crankshaft in a direction perpendicular to the x-axis: a length of said connecting rod is represented by L4; a length of said first arm is represented by L2; a length of said second arm is represented by L1; a length of said control rod is represented by L3; a length from the axis of said crankshaft to axes of said rotary shafts in a direction of the y-axis is represented by L5; a length from the axis of said crankshaft to the axes of said rotary shafts in a direction of the x-axis is represented by L6; an angle formed by said connecting rod with respective to the cylinder axis is represented by $\phi$4; an angle formed by said first and second arm is represented by $\alpha$; an angle formed by said second arm with the y-axis within the x-y plane is represented by $\phi 1$; an angle formed by said control rod with the y-axis is represented by $\phi 3$; an angle formed by a straight line connecting the axis of said crankshaft and said crankpin with the x-axis is represented by $\theta$; an angle formed by a straight line connecting the axes of said rotary shafts and the axis of said movable eccentric shaft with the x-axis is represented by $\theta p$; a value of the angle $\theta p$ is represented by $\gamma$ when the angle $\theta$ is "0"; a length between the axis of said crankshaft and said crankpin is represented by R; a length of the straight line connecting the axes of said rotary shafts and the axis of said movable eccentric shaft is represented by Rp; a rotational angular speed of said crankshaft is represented by $\omega$; and a ratio of the rotational speed of said movable eccentric shaft to the rotational speed of said crankshaft is represented by $\eta$ and the rotational direction thereof is represented by $\eta=+0.5$ or $\eta=-0.5$, the following equation is established:

$$-L4\cdot\sin\phi 4\cdot d\phi 4/dt+L2\cdot\cos(\alpha+\phi 1)\cdot d\phi 1/dt-R\cdot\omega\cdot\sin\theta=0$$

Wherein $\phi 4=\arcsin\{L2\cdot\cos(\alpha+\phi 1)+R\cdot\sin\theta-\delta\}/L4$ $d\phi 4/dt=\omega\cdot[-L2\cdot\sin(\alpha+\phi 1)\cdot\{R\cdot\cos(\theta-\phi 3)-\eta\cdot Rp\cdot\cos(\theta p-\phi 3)\}/\{L1\cdot\sin(\phi 1+\phi 3)\}+R\cdot\cos\theta\}]/(L4\cdot\cos\phi 4)$ $\phi 1=\arcsin[(L3^2-L1^2-C^2-D^2)/(2\cdot L1\cdot\sqrt{(C^2+D^2)}\}]-\arctan(C/D)$ $\phi 3=\arcsin\{(R\cdot\cos\theta-L6-Rp\cdot\cos\theta p+L1\cdot\sin\phi 1)/L3\}$ $C=L5+Rp\cdot\sin\theta p-R\cdot\sin\theta$ $D=L6+Rp\cdot\cos\theta p-R\cdot\cos\theta$ $\theta p=\eta\cdot\theta+\gamma$ $d\phi 1/dt=\omega\cdot\{R\cdot\cos(\theta-\phi 3)-\eta\cdot Rp\cdot\cos(\theta p-\phi 3)\}/(L1\cdot\sin(\phi 1+\phi 3)\}$ and crank angles $\theta$ at a top dead center at each of the intake and exhaust strokes and at the top dead center at the compression stroke are determined from said equation, and the length L1 of said second arm; the length L2 of said first arm; the length L3 of said control rod; the length L4 of said connecting rod; the length L5 from the axis of said crankshaft to the axes of said rotary shafts in the direction of the y-axis; the length L6 from the axis of said crankshaft to the axes of said rotary shafts in the direction of the x-axis; the amount $\delta$ of offsetting of the cylinder axis from the axis of said crankshaft in the direction of the y-axis; the angle a formed by said first and second arms; the length R between the axis of said crankshaft and said crankpin; the length Rp of the straight line connecting the axes of said rotary shafts and the axis of said movable eccentric shaft and the angle $\theta p$ when the angle $\theta$ is "0", are determined so that the top dead center at each of the intake and exhaust strokes and the top dead center at the compression stroke are congruous with each other, according to the following equation:

$$X=L4\cdot\cos\phi 4+L2\cdot\sin(\alpha+\phi 1)+R\cdot\cos\theta$$

which represents a level X of the piston pin at both said crank angles $\theta$.

2. An engine according to claim 1, wherein a locus of movement of said piston pin is determined to be fallen into a range between the x-axis and one of tangent lines parallel to the x-axis and tangent to a locus described at the expansion stroke by a point of connection between said connecting rod and said first arm, which is closest to said x-axis.

3. An engine according to claim 1, wherein the range of the crank angle at the expansion stroke is set larger than that at the intake stroke, and the range of the crank angle at the exhaust stroke is set larger than that at the compression stroke.

4. An engine according to claim 3, wherein the ranges of the crank angles at the expansion and exhaust strokes are set at values exceeding 180 degrees, respectively.

5. An engine according to claim 4, wherein said movable eccentric shaft is mounted on said rotary shafts having the axes disposed at locations spaced within said x-y plane apart from the axis of said crankshaft by the lengths L5 and L6 in the directions of the y-axis and the x-axis, respectively, so that it is displaced from the axes of said rotary shafts by a distance corresponding to a radius Rp, and wherein when the length R between the axis of said crankshaft and said crankpin is set at 1.0, the length L1 of said second arm is set in a range of 1.7 to 4.5; the length L2 of said first arm is set in a range of 0.6 to 5.2; the length L3 of said control rod is set in a range of 4.3 to 6.9; the length L5 between the axis of said crankshaft and said rotary shafts in the direction of the y-axis is set in a ranger of 2.3 to 4.0; the length L6 between the axis of said crankshaft and said rotary shafts in the direction of the x-axis is set in a range of 0.00 to 3.35; and said radius Rp is set in a range of 0.25 to 1.80, as well as the angle $\alpha$ formed by said first and second arms is set in a range of 105 to 180 degrees.

* * * * *